US009223250B2

(12) United States Patent
Mori et al.

(10) Patent No.: US 9,223,250 B2
(45) Date of Patent: Dec. 29, 2015

(54) DEVELOPMENT APPARATUS AND IMAGE FORMING APPARATUS INCLUDING THE SAME

(71) Applicant: BROTHER KOGYO KABUSHIKI KAISHA, Nagoya-shi, Aichi-ken (JP)

(72) Inventors: Hiroki Mori, Nagoya (JP); Tatsuo Ogasawara, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/526,671

(22) Filed: Oct. 29, 2014

(65) Prior Publication Data

US 2015/0117904 A1 Apr. 30, 2015

(30) Foreign Application Priority Data

Oct. 31, 2013 (JP) ..... 2013-227748

(51) Int. Cl.
*G03G 15/08* (2006.01)

(52) U.S. Cl.
CPC ..... *G03G 15/0891* (2013.01); *G03G 15/0877* (2013.01); *G03G 15/0889* (2013.01); *G03G 15/0896* (2013.01)

(58) Field of Classification Search
CPC ..... G03G 15/0891; G03G 15/0887; G03G 15/0889
USPC ..... 399/254, 256, 281
See application file for complete search history.

(56) References Cited

U.S. PATENT DOCUMENTS

| | | | | |
|---|---|---|---|---|
| 5,875,378 | A | 2/1999 | Campbell et al. | |
| 6,771,922 | B2 * | 8/2004 | Blanck et al. | 399/254 X |
| 7,860,437 | B2 * | 12/2010 | Kakuta et al. | 399/281 |
| 2004/0126143 | A1 | 7/2004 | Blanck et al. | |
| 2006/0171743 | A1 * | 8/2006 | Mori et al. | 399/254 X |
| 2008/0240775 | A1 * | 10/2008 | Mase | 399/256 X |
| 2013/0287425 | A1 | 10/2013 | Takagi | |

FOREIGN PATENT DOCUMENTS

| | | | |
|---|---|---|---|
| EP | 0 849 642 | A1 | 6/1998 |
| JP | 10-198151 | A | 7/1998 |
| JP | 2012-137655 | A | 7/2012 |
| JP | 2014-016486 | A | 1/2014 |

OTHER PUBLICATIONS

Extended European Search Report issued in European Patent Application No. 14190825.1, mailed Apr. 23, 2015.

* cited by examiner

*Primary Examiner* — Sophia S Chen
(74) *Attorney, Agent, or Firm* — Merchant & Gould PC

(57) ABSTRACT

A development apparatus is provided, including a case; a roller member configured to transport a developer; an agitating member configured to agitate the developer; and a movable transport member configured to transport the developer, which is agitated by the agitating member, toward the roller member. The case includes a first accommodating section which is formed with a filling port and which is arranged with the agitating member; and a second accommodating section which is arranged with the roller member and which is communicated with the first accommodating section. The transport member is arranged on a side of the roller member as compared with the agitating member; and the filling port is arranged so that the filling port is overlapped with a movement locus of the transport member as viewed in an axial direction lying along an axis of rotation of the agitating member.

13 Claims, 8 Drawing Sheets

DEVELOPMENT APPARATUS AND IMAGE FORMING APPARATUS INCLUDING THE SAME

CROSS REFERENCE TO RELATED APPLICATION

The present application claims priority from Japanese Patent Application No. 2013-227748, filed on Oct. 31, 2013, the disclosure of which is incorporated herein by reference in its entirety.

BACKGROUND

1. Field of the Invention

The present invention relates to a development apparatus equipped for an image forming apparatus for which the electrophotography system is adopted, and an image forming apparatus including the development apparatus.

2. Description of the Related Art

Conventionally, a cartridge is known, which is installed to an image forming apparatus for which the electrophotography system is adopted.

The cartridge is provided with, for example, a toner hopper which accommodates the toner, a paddle which is rotatable in the toner hopper in order to agitate or mix the toner contained in the toner hopper, a toner adding roller which is provided to transport the toner to a developing roller, and an agitator which is provided to transfer the toner to the toner adding roller.

Thus, the agitator is lifted up by being engaged with the rotating paddle, and then the agitator is released from the engagement with the paddle. Accordingly, the agitator falls by means of the gravity. In this situation, the agitator transfers the toner toward the toner adding roller.

SUMMARY

However, in the case of the cartridge as described above, any malfunction of the agitator is caused in some cases, for example, on account of the assembling and/or the dimensional error of any part. In view of the above, it is demanded to confirm the operation of the agitator after the assembling of the cartridge in the production line. However, it is difficult to confirm the operation of the agitator arranged in the toner hopper after the assembling of the cartridge.

In view of the above, an object of the present teaching is to provide a development apparatus which makes it possible to confirm the movement of a transport member easily and reliably, and an image forming apparatus including the development apparatus.

In order to achieve the object described above, according to the present teaching, there is provided a development apparatus including:

a case configured to accommodate a developer;

a roller member rotatably supported by the case and configured to transport a developer;

an agitating member rotatably supported by the case, and configured to agitate the developer; and a movable transport member configured to transport the developer, which is agitated by the agitating member, toward the roller member;

wherein the case includes:

a first accommodating section in which the agitating member is arranged, and in which a filling port for performing filling with a developer is formed, and a second accommodating section in which the roller member is arranged and which is communicated with the first accommodating section;

wherein the transport member is arranged on a side of the roller member as compared with the agitating member; and wherein the filling port is arranged such that the filling port is overlapped with a movement locus of the transport member as viewed in an axial direction lying along an axis of rotation of the agitating member.

According to the configuration as described above, the filling port is arranged so that the filling port is overlapped with the movement locus of the transport member as viewed in the axial direction. Therefore, it is possible to realize a small size of the development apparatus, while it is possible to confirm the movement of the transport member via the filling port. In other words, even after the assembling of the development apparatus, it is possible to confirm the movement of the transport member via the filling port easily and reliably.

Therefore, according to the development apparatus of the present teaching, it is possible to realize the small size and the simplification, while it is possible to confirm the movement of the transport member easily and reliably.

DESCRIPTION OF THE PREFERRED EMBODIMENTS

Outline of Developing Cartridge

Figure 1A:
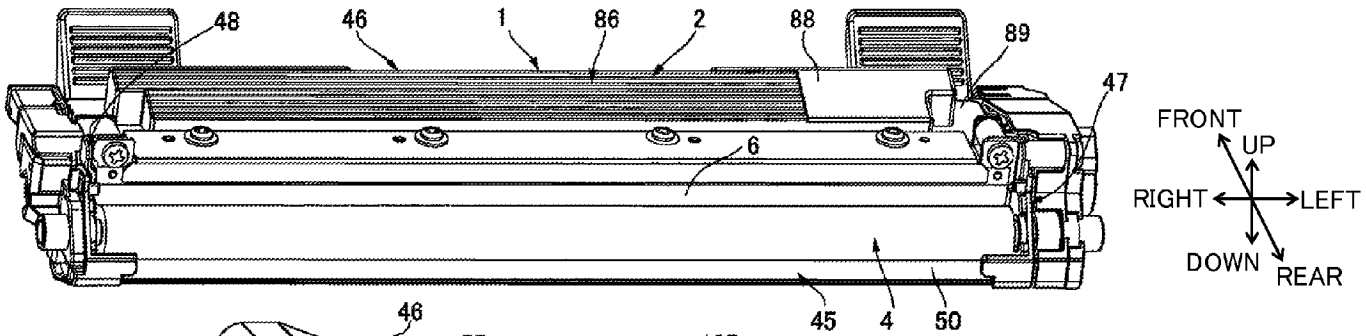
FIG. 1A shows a perspective view illustrating a developing cartridge as an embodiment of the development apparatus of the present teaching as viewed from a right-back position.
Figure 1B:
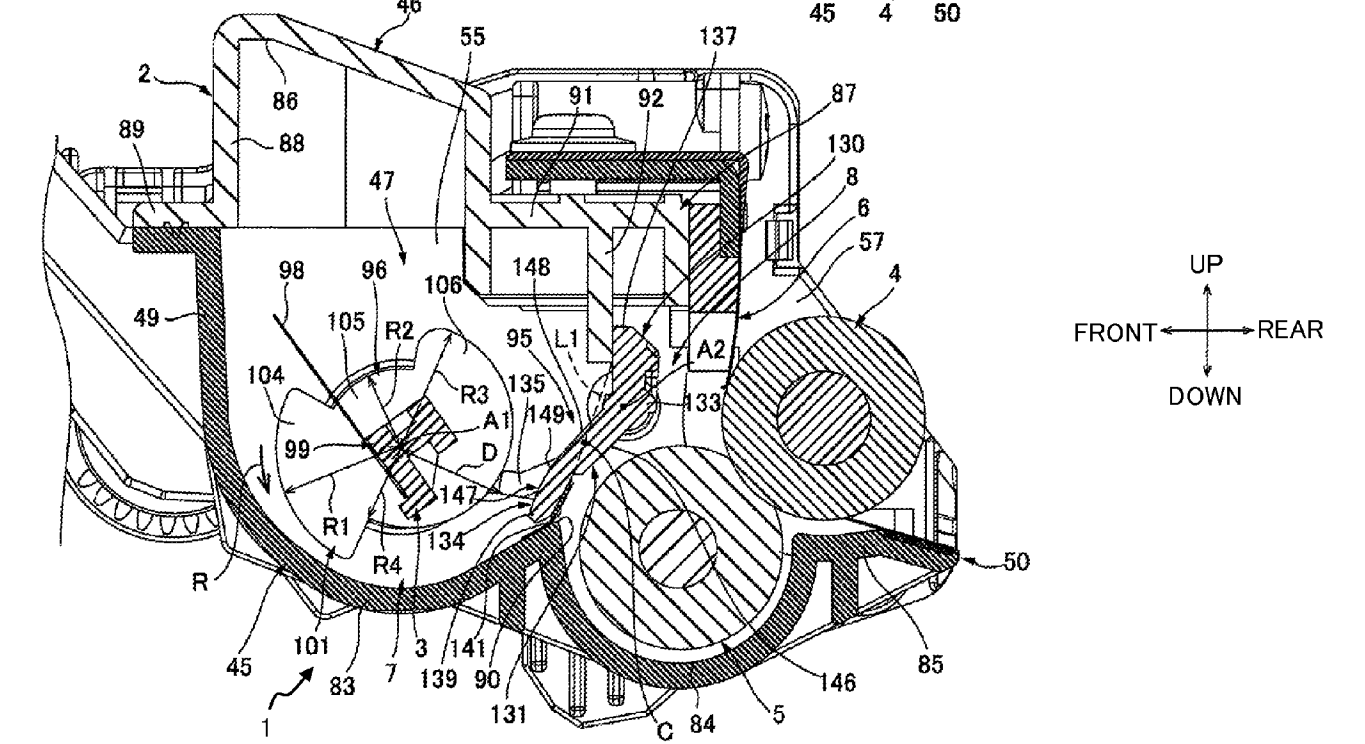
FIG. 1B shows a right side sectional view illustrating the developing cartridge depicted in FIG. 1A.

As depicted in FIG. 1A and FIG. 1B, a developing cartridge 1, which is referred to as an example of the development apparatus, is provided with a case 2, an agitator 3 which is an example of the agitating member, a supply roller 5 which is an example of the roller member, a developing roller 4, and a layer thickness regulating blade 6.

In the following description, in a case that the direction concerning the developing cartridge 1 is mentioned, the direction in which the developing roller 4 is arranged is defined as the rear side of the developing cartridge 1, and the direction opposite to the direction in which the developing roller 4 is arranged is defined to as the front side of the developing cartridge 1. That is, when the sheet surface of FIG. 1 is placed in a landscape direction, the left side of FIG. 1 is defined as the rear side of the developing cartridge 1 and the right side of FIG. 1 is defined as the front side of the developing cartridge 1. Further, the upper side of FIG. 1 is defined as the upper side of the developing cartridge 1 and the lower side of FIG. 1 is defined as the lower side of the developing cartridge 1. Further, the direction when the developing cartridge 1 is viewed from the frontward position is used as a reference of the left-right direction of the developing cartridge 1. That is, the near side of the sheet surface of FIG. 1 is defined as the left side of the developing cartridge 1 and the back or far side of the sheet surface of FIG. 1 is defined as the right side of the developing cartridge 1. Specifically, the respective directions are depicted by arrows in the drawings.

Further, the left-right direction is an example of the axial direction, the right is one of the axial direction, and the left is the other of the axial direction. Further, the front-rear direction is an example of the adjoining direction, the rear is one of the adjoining direction, and the front is the other of the adjoining direction. The up-down direction is an example of the orthogonal direction, the upward is one of the orthogonal direction, and the downward is the other of the orthogonal direction. In this context, the up-down direction is the vertical direction, and the front-rear/left-right direction is the horizontal direction.

As depicted in FIG. 1A, the case 2 has a substantially box-shaped form extending in the left-right direction, and the case 2 accommodates the toner as an example of the developer. Further, the rear end portion of the case 2 is open in the front-rear direction.

As depicted in FIG. 1B, the agitator 3 is arranged at a front portion of the case 2.

The supply roller 5 is arranged at the lower-rear side of the agitator 3 in the case 2. Further, the supply roller 5 is rotatably supported by the case 2.

The developing roller 4 is arranged at the upper-rear side of the supply roller 5, and the developing roller 4 is arranged at the rear end portion of the case 2. The lower-front end portion of the developing roller 4 is brought in contact under pressure with the upper-rear end portion of the supply roller 5. Further, the upper portion and the rear portion of the developing roller 4 are exposed from the case 2. Thus, the developing roller 4 is rotatably supported by the case 2.

The layer thickness regulating blade 6 is arranged in the upper-front side of the developing roller 4. The lower end portion of the layer thickness regulating blade 6 is brought in contact with the front end portion of the developing roller 4.

<Embodiment of Use of Developing Cartridge>

Figure 7:
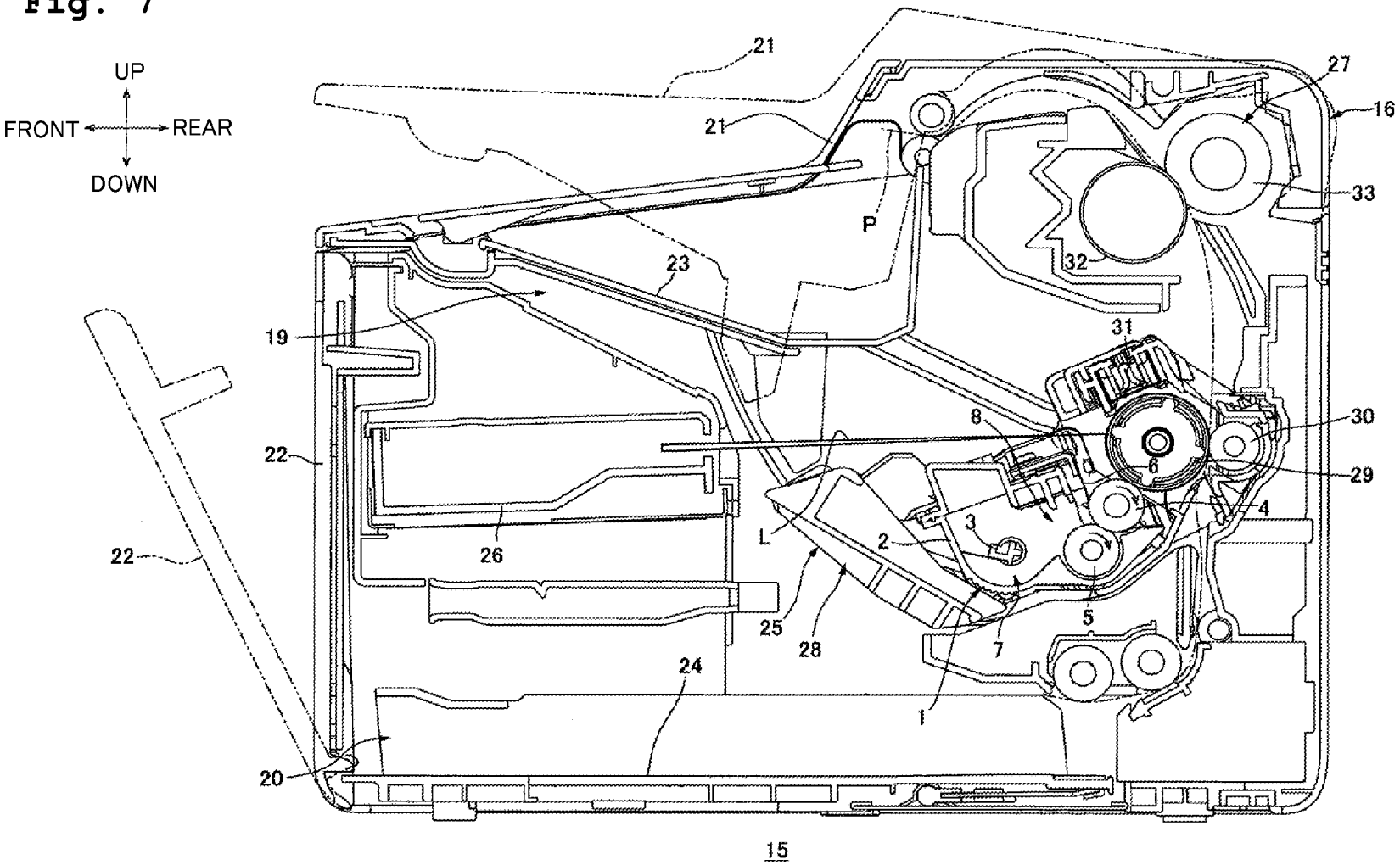
FIG. 7 shows a central sectional view illustrating a printer to which the developing cartridge depicted in FIG. 1A is installed.

The developing cartridge 1 as described above is equipped for a printer 15 as depicted in FIG. 7.

The printer 15 is a monochrome printer or a black and white printer based on the electrophotography system. The printer 15 is provided with a casing 16, a process cartridge 25, a scanner unit 26, and a fixing unit 27. When the direction is referred to in relation to the printer 15, the state, in which the printer 15 is placed in the horizontal direction, is used as the basis or reference. Specifically, the arrow directions depicted in FIG. 7 are used as the basis or reference.

The casing 16 has a substantially box-shaped form. The casing 16 has a cartridge opening 19, a top cover 21, a recording paper opening 20, a paper feed cover 22, a recording paper placing section 24, and a paper discharge tray 23.

The cartridge opening 19 is arranged at an upper end portion of the casing 16. The top cover 21 has a substantially flat plate-shaped form extending in the front-rear direction. The top cover 21 is swingably supported by the upper end portion of the back wall of the casing 16 by using the rear end portion thereof as a support point. The top cover 21 opens or closes the cartridge opening 19.

The recording paper opening 20 is arranged at a lower portion of the front end portion of the casing 16, and the recording paper opening 20 penetrates through the front end portion of the casing 16 in the front-rear direction.

The paper feed cover 22 is swingably supported by the front end portion of the bottom wall of the casing 16 by using the lower end portion thereof as the support point. The paper feed cover 22 opens or closes the recording paper opening 20.

The recording paper placing section 24 is arranged at a lower end portion of the casing 16. The recording paper placing section 24 is constructed so that the recording paper P is placed thereon.

The paper discharge tray 23 is arranged at a front portion of the upper wall of the casing 16. The paper discharge tray 23 is recessed downwardly from the upper surface of the casing 16 so that the recording paper P is placed.

The process cartridge 25 is arranged at a substantially central portion in the up-down direction of the casing 16. The process cartridge 25 is constructed so that the process cartridge is installed to or removed (disengaged) from the casing 16 via the cartridge opening 19.

The process cartridge 25 is provided with a drum cartridge 28 and a developing cartridge 1.

The drum cartridge 28 is provided with a photosensitive drum 29, a transfer roller 30, and a scorotron type charging unit 31.

The photosensitive drum 29 is rotatably supported at a rear portion of the drum cartridge 28.

The transfer roller 30 is positioned at the back of the photosensitive drum 29, and the transfer roller 30 is rotatably supported at a rear portion of the drum cartridge 28. The front end portion of the transfer roller 30 is brought in contact under pressure with the rear end portion of the photosensitive drum 29.

The scorotron type charging unit 31 is arranged in front of and above the photosensitive drum 29 while providing a spacing.

The developing cartridge 1 is constructed so that the developing cartridge 1 is installed to or removed (disengaged) from the drum cartridge 28. Accordingly, the developing cartridge 1 is constructed so that the developing cartridge 1 is installed to or removed (disengaged) from the casing 16.

The developing cartridge 1 is positioned in front of and below the photosensitive drum 29 in a state of being installed to the drum cartridge 28. The upper-rear end portion of the developing roller 4 of the developing cartridge 1 is brought in contact with the lower-front end portion of the photosensitive drum 29.

The scanner unit 26 is arranged in front of the process cartridge 25 in the casing 16. The scanner unit 26 is constructed so that the scanner unit 26 emits or outputs the laser beam L toward the photosensitive drum 29 on the basis of the image data. In other words, the scanner unit 26 is constructed so that the scanner unit 26 emits or outputs the laser beam L toward the photosensitive drum 29. Further, the laser beam L is subjected to the scanning on the photosensitive drum 29 while repeating the blinking so that a latent image, which is based on the image data, is formed on the photosensitive drum 29.

The fixing unit 27 is arranged above the process cartridge 25. The fixing unit 27 is provided with a heating roller 32 and a pressing roller 33. The pressing roller 33 is arranged at the upper-rear side of the heating roller 32. The lower-front end portion of pressing roller 33 is brought in contact under pressure with the upper-rear end portion of the heating roller 32.

As for the printer 15 as described above, at first, an operator swings the paper feed cover 22 to open the recording paper opening 20. Then, the rear portion of the recording paper P is introduced into the casing 16 via the recording paper opening 20. Accordingly, the rear portion of the recording paper P is stacked on the upper surface of the recording paper placing section 24 at the inside of the casing 16, and the front portion of the recording paper P is stacked on the upper surface of the paper feed cover 22 at the outside of the casing 16.

Subsequently, when the image forming operation is started in accordance with the control of an unillustrated control unit, the scorotron type charging unit 31 uniformly charges or electrifies the surface of the photosensitive drum 29. The scanner unit 26 performs the exposure for the surface of the photosensitive drum 29. Accordingly, an electrostatic latent image, which is based on the image data, is formed on the surface of the photosensitive drum 29.

Further, the toner contained in the case 2 is agitated by the agitator 3, and the toner is supplied to the supply roller 5. The toner, which is supplied by the agitator 3, is transported by the supply roller 5 toward the developing roller 4. Then, the toner is frictionally charged between the developing roller 4 and the supply roller 5, and the toner is carried on the developing roller 4. The toner, which is carried on the circumferential surface of the developing roller 4, is regulated to have a constant thickness by the layer thickness regulating blade 6.

Then, the toner, which is carried on the developing roller 4, is supplied to the electrostatic latent image formed on the surface of the photosensitive drum 29. The toner image, which is formed on the surface of the photosensitive drum 29, is transferred to the recording paper P when the recording paper P passes through the space between the photosensitive drum 29 and the transfer roller 30.

After that, the recording paper P is heated and pressed when the recording paper P passes through the space between the heating roller 32 and the pressing roller 33. Accordingly, the toner image, which is formed on the recording paper P, is thermally fixed on the recording paper P. After that, the recording paper P is discharged to the paper discharge tray 23.

In this way, the recording paper P is transported along with the transport route having the substantially C-shaped form as viewed in a side view from the recording paper placing section 24 to the paper discharge tray 23 in accordance with the image forming operation of the printer 15.

<Details of Developing Cartridge>

The case 2 is composed of resin, and the case 2 is provided with a first frame 45 and a second frame 46 as depicted in FIG. 1B.

<First Frame>

Figures 2A, 2B:
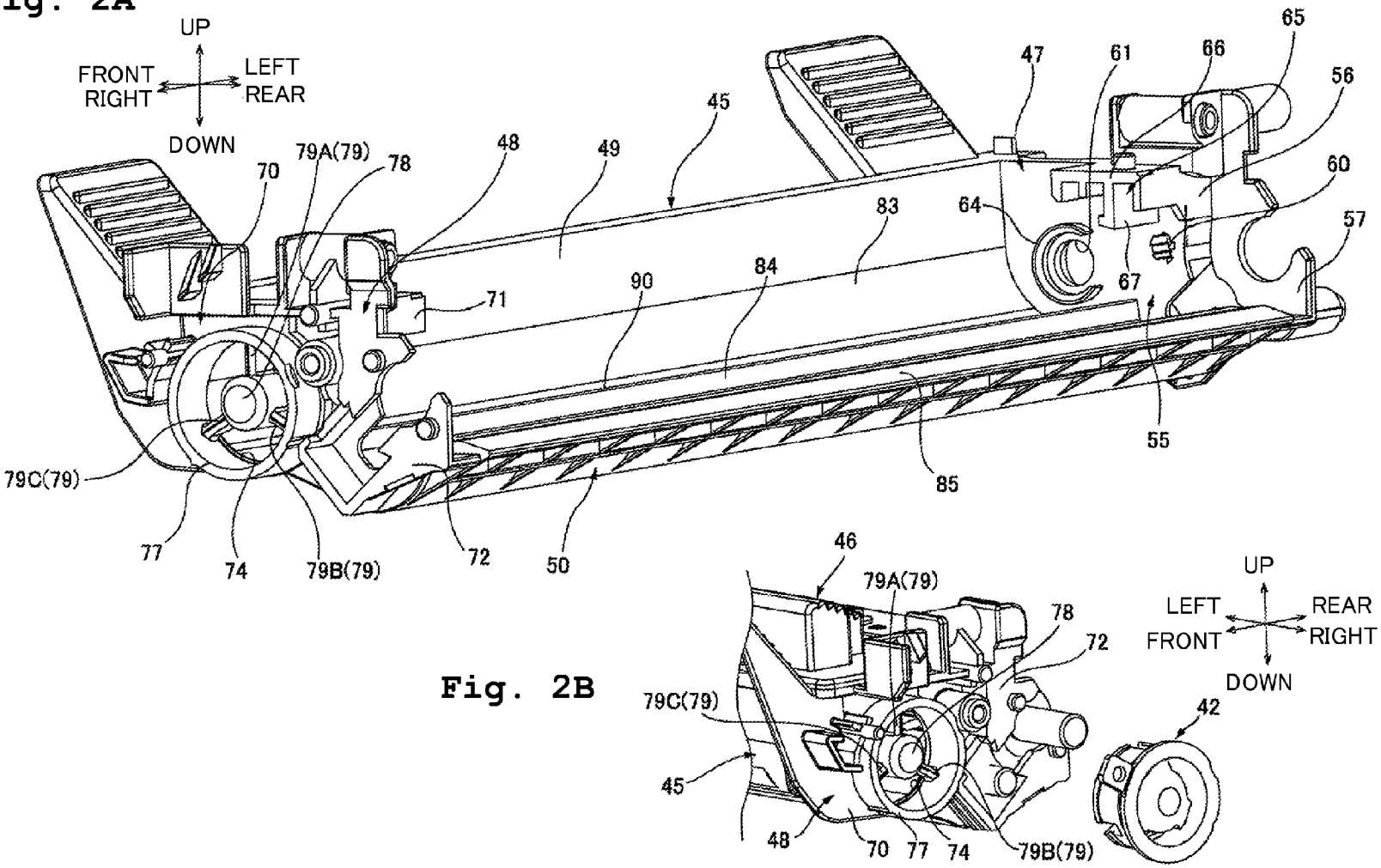
FIG. 2A shows a perspective view illustrating a first frame depicted in FIG. 1 as viewed from a right-back position.
FIG. 2B shows a perspective view illustrating the first frame depicted in FIG. 2A as viewed from a right-front position.

The first frame 45 constitutes the lower portion of the case 2. As depicted in FIG. 2A, the first frame 45 integrally has a left side wall 47, a right side wall 48, a front wall 49, and a bottom wall 50.

The left side wall 47 is arranged at the left end portion of the first frame 45. The left side wall 47 has a substantially rectangular plate-shaped form as viewed in a side view, and the left side wall 47 has a substantially crank-shaped form as viewed in a plan view.

The left side wall 47 integrally has a front portion 55, a bent portion 56, and a rear portion 57. The front portion 55 has a substantially rectangular form extending in the front-rear direction as viewed in a side view. The bent portion 56 continuously protrudes toward the left from the rear end portion of the front portion 55, and the bent portion 56 has a substantially rectangular form extending in the up-down direction as viewed in a back view. The rear portion 57 continuously extends toward the back from the left end portion of the bent portion 56, and the rear portion 57 has a substantially rectangular form as viewed in a side view.

Further, the left side wall 47 is formed with a shaft insertion hole 60 and a gear insertion hole 61.

The shaft insertion hole 60 is arranged at a substantially central portion in the up-down direction of the rear end portion of the front portion 55. The shaft insertion hole 60 has a substantially circular shape as viewed in a side view, and the shaft insertion hole 60 penetrates through the front portion 55 in the left-right direction.

The gear insertion hole 61 is arranged while providing a spacing in front of and below the shaft insertion hole 60 at the front portion 55. The gear insertion hole 61 has a substantially circular shape as viewed in a side view, and the gear insertion hole 61 is recessed toward the left from the right surface of the front portion 55.

Further, the left side wall 47 integrally has a spring support section 64 and a spring fastening section 65.

The spring support section 64 is arranged at the circumferential edge of the gear insertion hole 61 so that the gear insertion hole 61 is surrounded on the right surface of the front portion 55. The spring support section 64 has a substantially C-shaped form as viewed in a side view which is open toward the back, and the spring support section 64 protrudes toward the right from the right surface of the front portion 55. In other words, the spring support section 64 has a partially cylindrical form extending in the left-right direction. Further, the inner diameter of the spring support section 64 is larger than the inner diameter of the gear insertion hole 61, which is approximately the same as the outer diameter of a coil spring 94 described later on.

The spring fastening section 65 is arranged at the upper-rear side of the spring support section 64 and in front of and above the shaft insertion hole 60 on the right surface of the front portion 55.

The spring fastening section 65 integrally has a protruding wall 66 and a fastening wall 67.

The protruding wall 66 protrudes toward the right from the rear portion of the upper end portion of the front portion 55. The protruding wall 66 has a substantially rectangular plate-shaped form extending in the front-rear direction as viewed in a plan view. Further, the upper surface of the protruding wall 66 is flush with the upper end surface of the front portion 55.

Figure 4:
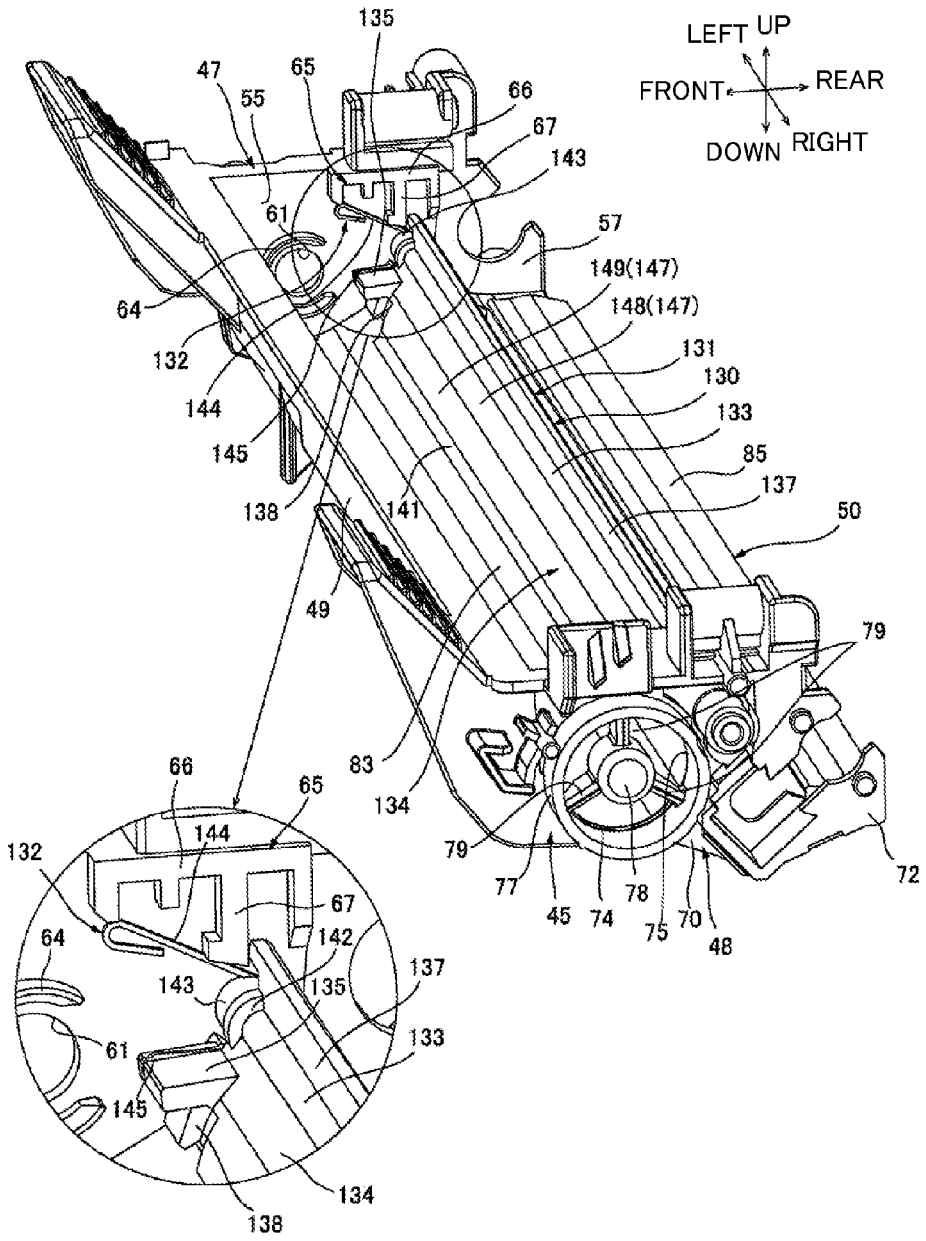
FIG. 4 shows a perspective view illustrating the first frame assembled with the transport unit depicted in FIG. 3 as viewed from an upper-right position.

As depicted in FIG. 4, the fastening wall 67 protrudes toward the bottom (downward) from the substantially central portion in the front-rear direction of the lower surface of the protruding wall 66, and the fastening wall 67 has a substantially rectangular form extending in the up-down direction as viewed in a side view. Further, as depicted in FIG. 2A, the fastening wall 67 extends in the left-right direction, and the left end portion of the fastening wall 67 is connected to the right surface of the front portion 55.

The right side wall 48 is arranged at the right end portion of the first frame 45, and the right side wall 48 is arranged while providing a spacing on the right with respect to the left side wall 47. Further, the right side wall 48 has a substantially rectangular plate-shaped form as viewed in a side view in the same manner as the left side wall 47, and the right side wall 48 has a substantially crank-shaped form as viewed in a plan view.

The right side wall 48 integrally has a front portion 70, a bent portion 71, and a rear portion 72. The front portion 70 has a substantially rectangular form extending in the front-rear direction as viewed in a side view. The bent portion 71 continuously protrudes toward the right from the rear end portion of the front portion 70, and the bent portion 71 has a substantially rectangular form extending in the up-down direction as viewed in a back view. The rear portion 72 continuously protrudes toward the back from the right end portion of the bent portion 71, and the rear portion 72 has a substantially rectangular form as viewed in a side view.

Further, the right side wall 48 is formed with an unillustrated shaft insertion hole and a toner filling port 74 which is an example of the filling port. In other words, the toner filling port 74 is arranged at the right end portion of the case 2.

The unillustrated shaft insertion hole is arranged so that the shaft insertion hole is coincident with the shaft insertion hole 60 of the left side wall 47 when the shaft insertion hole is projected in the left-right direction. The shaft insertion hole is arranged at a substantially central portion in the up-down direction of the rear end portion of the front portion 70. The unillustrated shaft insertion hole has the same shape and the same size as those of the shaft insertion hole 60, and the shaft insertion hole is recessed toward the right from the left surface of the front portion 70.

The toner filling port 74 is arranged at a substantially central position of the front portion 70 as viewed in a side view. The toner filling port 74 has a substantially circular shape as viewed in the left-right direction, and the toner filling port 74 penetrates through the front portion 70 in the left-right direction. Further, the center of the toner filling port 74 is coincident with the center of the gear insertion hole 61 when the toner filling port 74 is projected in the left-right direction.

Further, as depicted in FIG. 2A and FIG. 2B, the right side wall 48 has a cylindrical section 77, a bearing section 78, a plurality of crosspiece sections 79, and a cap 42.

As depicted in FIG. 2A, the cylindrical section 77 is arranged on the right surface of the front portion 70. The cylindrical section 77 has a substantially cylindrical form extending in the left-right direction, and the cylindrical section 77 protrudes toward the right from the circumferential edge of the toner filling port 74.

The bearing section 78 is arranged in the cylindrical section 77. The bearing section 78 has a substantially cylindrical form extending in the left-right direction, and the right end portion of the bearing section 78 is closed. The outer diameter of the bearing section 78 is smaller than the inner diameter of the cylindrical section 77. Further, the central axis of the bearing section 78 is coincident with the central axis of the cylindrical section 77.

Each of a plurality of crosspiece sections 79 has a plate-shaped form extending in the radial direction of the cylindrical section 77. The plurality of crosspiece sections 79 connect the inner circumferential surface of the cylindrical section 77 and the outer circumferential surface of the bearing section 78.

Figure 5A:
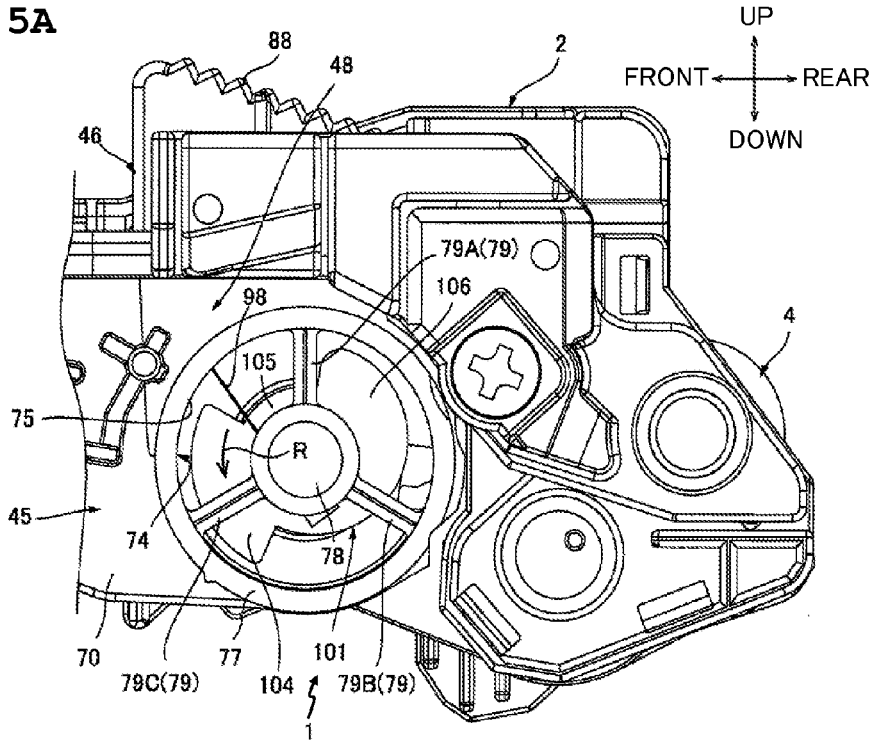
FIG. 5A shows a right side view illustrating the developing cartridge depicted in FIG. 1A, depicting a state in which a transport member is disposed at a first position.

As depicted in FIG. 5A, the plurality of crosspiece sections 79 are arranged while mutually providing spacings of about 120° in the circumferential direction of the cylindrical section 77. In particular, the plurality of crosspiece sections 79 are provided with a first crosspiece section 79A, a second crosspiece section 79B, and a third crosspiece section 79C.

The first crosspiece section 79A extends in the up-down direction, and the first crosspiece section 79A connects the upper end portion of the inner circumferential surface of the cylindrical section 77 and the upper end portion of the outer circumferential surface of the bearing section 78. The second crosspiece section 79B is arranged at the lower-rear side of the first crosspiece section 79A. The second crosspiece section 79B extends in the direction to connect upper position on the front and the lower position on the back, and the second crosspiece section 79B connects the lower-rear end portion of the inner circumferential surface of the cylindrical section 77 and the lower-rear end portion of the outer circumferential surface of the bearing section 78. The third crosspiece section 79C is arranged downwardly in the front direction with respect to the first crosspiece section 79A. The third crosspiece section 79C extends in the direction to connect the downward front and the upward back, and the third crosspiece section 79C connects the lower-front end portion of the inner circumferential surface of the cylindrical section 77 and the lower-front end portion of the outer circumferential surface of the bearing section 78.

As depicted in FIG. 2B, the cap 42 is constructed so that the cap 42 is installed to or removed from the cylindrical section 77. The cap 42 has a substantially cylindrical form extending in the left-right direction, and the left end portion of the cap 42 is closed. The outer diameter of the cap 42 is substantially the same as the inner diameter of the cylindrical section 77. Then, the cap 42 is inserted into the cylindrical section 77 from the right, and thus the cap 42 is installed to the right side wall 48. Accordingly, the cap 42 closes the toner filling port 74.

As depicted in FIG. 2A, the front wall 49 is arranged at a front end portion of the first frame 45, and the front wall 49 is provided to span the front end portions of the left side wall 47 and the right side wall 48. The front wall 49 has a substantially rectangular plate-shaped form extending in the left-right direction as viewed in a front view.

The bottom wall 50 is arranged at a lower end portion of the first frame 45, and the bottom wall 50 is provided to span the lower end portions of the left side wall 47 and the right side wall 48. Further, the front end portion of the bottom wall 50 is connected to the lower end portion of the front wall 49.

In particular, as depicted in FIG. 1B, the bottom wall 50 integrally has a curved section 83, a circular arc section 84, and a lip section 85.

The curved section 83 is the front portion of the bottom wall 50. The curved section 83 continuously extends toward the rear from the lower end portion of the front wall 49, and the curved section 83 is curved toward the bottom (downward).

The circular arc section 84 is arranged adjacently at the rear of the curved section 83. The circular arc section 84 has a semi-circular arc-shaped form as viewed in a side view which is open toward the top (upward). The inner circumferential surface of the circular arc section 84 extends along the circumferential surface of the supply roller 5. Further, the front end portion of the circular arc section 84 is connected to the rear end portion of the curved section 83.

The lip section 85 is arranged adjacently at the rear of the circular arc section 84, and the lip section 85 continuously extends toward the rear from the rear end portion of the circular arc section 84.

<Second Frame>

The second frame 46 is the upper portion of the case 2, and the second frame 46 covers the first frame 45 from the upward position.

As depicted in FIG. 1A, the second frame 46 has a substantially rectangular plate-shaped form extending in the left-right direction as viewed in a plan view. As depicted in FIG. 1B, the second frame 46 integrally has a front upper wall 86 and a rear upper wall 87.

The front upper wall 86 is the front portion of the second frame 46, and the front upper wall 86 has an expanded section 88 and a brim section 89.

The expanded section 88 has a substantially box-shaped form which is open toward the bottom (downward), and the expanded section 88 extends in the left-right direction as depicted in FIG. 1A.

The brim section 89 is arranged on the both left and right sides with respect to the expanded section 88 and in front of the expanded section 88 so that the brim section 89 surrounds the expanded section 88 as viewed in a plan view. In other words, the brim section 89 has a substantially]-shaped (angular U-shaped) form which is open toward the back as viewed in a plan view. Further, the left end portion of the right portion of the brim section 89 is connected to the lower end portion of the right wall of the expanded section 88, the right end portion of the left portion of the brim section 89 is connected to the lower end portion of the left wall of the expanded section 88, and the rear end portion of the front portion of the brim section 89 is connected to the lower end portion of the front wall of the expanded section 88.

As depicted in FIG. 1B, the upper rear wall 87 is the rear portion of the second frame 46, and the upper rear wall 87 has a flat plate section 91 and a partition wall 92.

The flat plate section 91 extends continuously toward the rear from the lower end portion of the back wall of the expanded section 88. Further, the flat plate section 91 has a substantially rectangular plate-shaped form extending in the left-right direction as viewed in a plan view.

The partition wall 92 is arranged at a substantially central portion in the front-rear direction on the lower surface of the flat plate section 91, and the partition wall 92 protrudes toward the bottom (downward) from the lower surface of the flat plate section 91. Further, the partition wall 92 extends in the left-right direction over the entire flat plate section 91, and the partition wall 92 has a substantially rectangular plate-shaped form as viewed in a back view.

<Case>

The case 2 is constructed such that the first frame 45 and the second frame 46 are combined with each other, and the front portion 55 of the left side wall 47, the front portion 70 of the right side wall 48, and the respective upper end portions of the front wall 49 are welded to the brim section 89 of the front upper wall 86.

Further, in the case 2, the upper rear wall 87 of the second frame 46 is adjacently arranged on the right of the spring fastening section 65 of the first frame 45. In particular, the flat plate section 91 of the upper rear wall 87 is adjacently arranged on the right of the protruding wall 66 of the spring fastening section 65, and the partition wall 92 of the upper rear wall 87 is adjacently arranged on the right of the fastening wall 67 of the spring fastening section 65. Further, the partition wall 92 and the connecting portion 90 of the curved section 83 and the circular arc section 84 are arranged while providing a spacing in the up-down direction.

The space, which is disposed at the back of the virtual line segment L1 to connect the lower end portion of the partition wall 92 and the upper end portion of the connecting portion 90 as viewed in a side sectional view of the case 2, is defined as the developing chamber 8 as an example of the second accommodating section, and the space, which is disposed in front of the virtual line segment L1, is defined as the toner accommodating chamber 7 as an example of the first accommodating section.

Further, the lower end portion of the partition wall 92, the lower end portion of the fastening wall 67, the upper end portion of the connecting portion 90, the right surface of the front portion 55 of the left side wall 47, and the left surface of the front portion 70 of the right side wall 48 define the communication port 95 as an example of the opening.

In other words, the case 2 has the toner accommodating chamber 7 and the developing chamber 8 which are adjacently arranged in the front-rear direction, and the communication port 95 which makes communication between the toner accommodating chamber 7 and the developing chamber 8 in the front-rear direction.

<Developing Chamber>

More specifically, as depicted in FIG. 1B and FIG. 2A, the developing chamber 8 is defined by the rear portion 57 of the left side wall 47, the rear end portions of the bent portion 56 and the front portion 55, the rear portion 72 of the right side wall 48, the rear end portions of the bent portion 71 and the front portion 70, the circular arc section 84 and the lip section 85 of the bottom wall 50, and the rear portion of the upper rear wall 87.

Further, as depicted in FIG. 1B, the developing cartridge 1 is provided with the developing roller 4, the supply roller 5, and the layer thickness regulating blade 6 in the developing chamber 8.

The developing roller 4 is arranged at the rear end portion of the developing chamber 8, and the developing roller 4 is arranged while providing a spacing above the lip section 85. The developing roller 4 has a substantially columnar form extending in the left-right direction.

Further, the developing roller 4 is supported by the case 2 such that the left end portion of the developing roller 4 is rotatably supported by the rear portion 57 of the left side wall 47, and the right end portion of the developing roller 4 is rotatably supported by the rear portion 72 of the right side wall 48.

The supply roller 5 is arranged in front of and below the developing roller 4 in the developing chamber 8, and the supply roller 5 is accommodated in the circular arc section 84. The supply roller 5 has a substantially columnar form extending in the left-right direction.

Further, the supply roller 5 is supported by the case 2 such that the left end portion of the supply roller 5 is rotatably supported by the lower-rear end portion of the front portion 55 of the left side wall 47, and the right end portion of the supply roller 5 is rotatably supported by the lower-rear end portion of the front portion 70 of the right side wall 48.

The layer thickness regulating blade 6 is arranged in front of and above the developing roller 4 in the developing chamber 8. As depicted in FIG. 1A, the layer thickness regulating blade 6 has a substantially rectangular plate-shaped form extending in the left-right direction as viewed in a rear view. Further, as depicted in FIG. 1B, the layer thickness regulating blade 6 is supported by the case 2 so that the lower end portion of the layer thickness regulating blade 6 is brought in contact with the front end portion of the circumferential surface of the developing roller 4.

<Toner Accommodating Chamber>

More specifically, as depicted in FIG. 1B and FIG. 2A, the toner accommodating chamber 7 is defined by the front portion 55 (except for the rear end portion) of the left side wall 47, the front portion 70 (except for the rear end portion) of the right side wall 48, the curved section 83 of the bottom wall 50, the front wall 49, and the front portions of the front upper wall 86 and the upper rear wall 87.

The developing cartridge 1 is provided with an agitator unit 96 in the toner accommodating chamber 7. In the following explanation, the term "outwardly in the radial direction" resides in the direction directed outwardly (in the outward direction) to make separation from the central axis in the radial direction, and the term "inwardly in the radial direction" resides in the direction directed inwardly (in the inward direction) directed toward the central axis in the radial direction.

Figure 3:
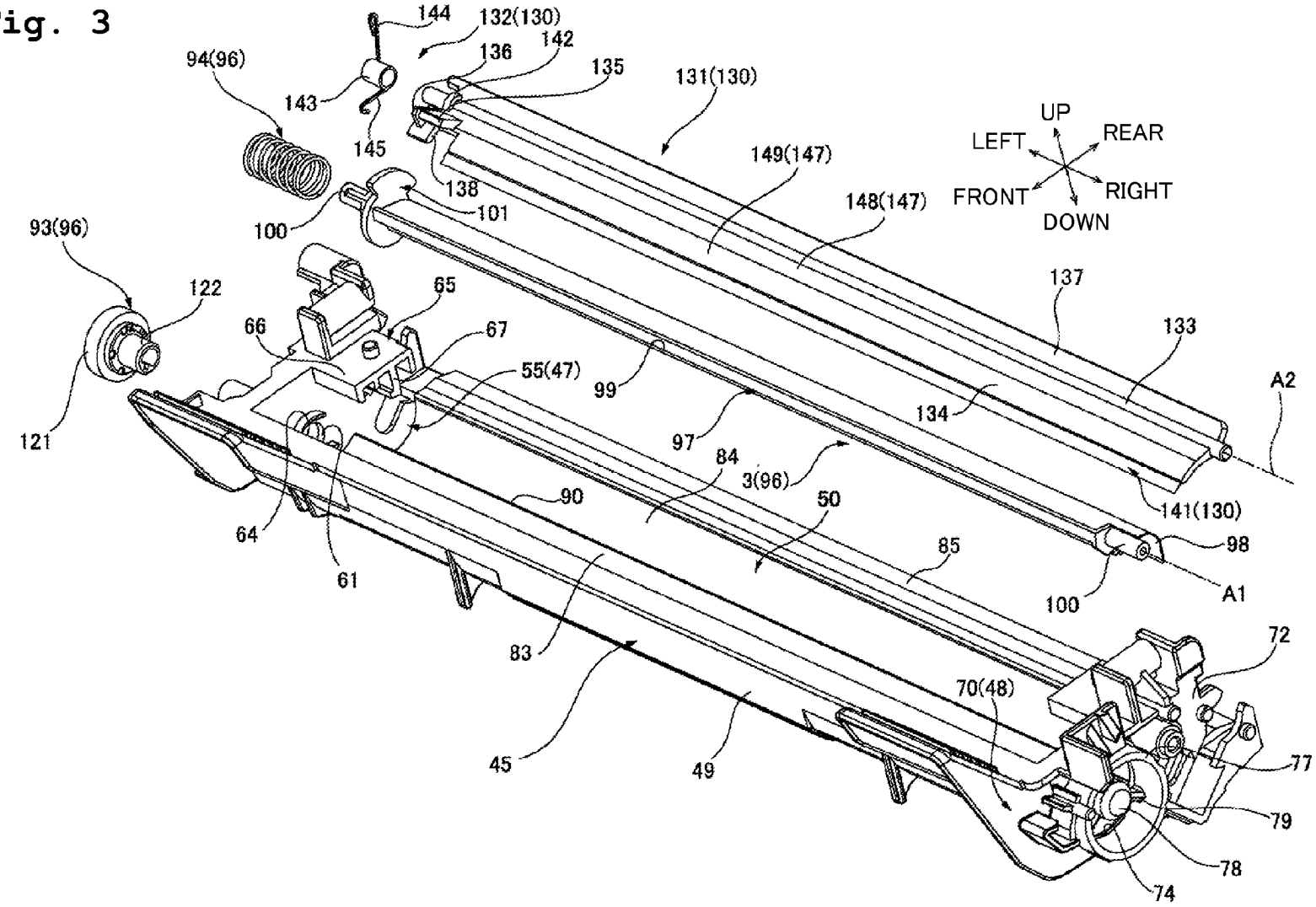
FIG. 3 shows an exploded perspective view illustrating the first frame depicted in FIG. 1B, an agitator unit, and a transport unit as viewed from an upper-right position.

The agitator unit 96 is arranged at a substantially central position as viewed in a side view in the toner accommodating chamber 7. As depicted in FIG. 3, the agitator unit 96 is provided with the agitator 3, the coil spring 94, and an agitator gear 93.

The agitator 3 is provided with an agitator shaft 97 and an agitating blade 98. Although described in detail later on, as depicted in FIG. 1B, when the driving force is input by the aid of the agitator gear 93, the agitator 3 is rotated in the rotation direction R. The rotation direction R is the counterclockwise direction as viewed in a right side view.

As depicted in FIG. 1B and FIG. 3, the agitator shaft 97 integrally has a main shaft body 99, a pair of rotational movement shafts 100, and a cam 101 as an example of the contact portion.

The main shaft body 99 has a substantially H-shaped form in cross section, and the main shaft body 99 extends in the left-right direction.

The pair of rotational movement shafts 100 are arranged one by one on the both left and right end surfaces of the main shaft body 99. As depicted in FIG. 3, each of the pair of rotational movement shafts 100 has a substantially columnar form extending in the left-right direction, and each of the rotational movement shafts 100 protrudes outwardly in the left-right direction from the end surface in the left-right direction of the main shaft body 99. Further, the pair of respective rotational movement shafts 100 are coincident with each other when they are projected in the left-right direction, and the central axes A1 of the respective rotational movement shafts 100 are positioned on the same straight line.

The cam 101 is disposed adjacently on the left of the main shaft body 99, and the cam 101 is arranged at the right end portion of the left rotational movement shaft 100. In other words, the cam 101 is arranged at the left end portion of the agitator 3, and the cam 101 is arranged on the side opposite to the toner filling port 74.

The cam 101 has a substantially circular plate-shaped form as viewed in a side view, and the cam 101 is spread from the circumferential surface of the left rotational movement shaft 100 outwardly in the radial direction of the rotational movement shaft 100. Therefore, the center of rotation of the cam 101 is coincident with the central axis A1 of the rotational movement shaft 100.

As depicted in FIG. 1B, the cam 101 has a large diameter portion 104, a small diameter portion 105, and a gradually decreasing portion 106.

The large diameter portion 104 is the portion at which the central angle is approximately 90° in the cam 101, and the large diameter portion 104 has a substantially sectoral form (fan-like form) as viewed in a side view. The radius of curvature R1 of the large diameter portion 104 is constant in relation to the entire large diameter portion 104 in the circumferential direction.

The small diameter portion 105 is adjacently arranged on the upstream in the rotation direction R with respect to the large diameter portion 104. The small diameter portion 105 is the portion at which the central angle is approximately 60° in the cam 101, and the small diameter portion 105 has a substantially sectoral form (fan-like form) as viewed in a side view. The radius of curvature R2 of the small diameter portion 105 is smaller than the radius of curvature R1 of the large diameter portion 104, which is constant in relation to the entire small diameter portion 105 in the circumferential direction. Further, the radius R2 of the small diameter portion 105 is shorter than the distance D between the front end portion of the cam contact portion 135 and the central axis A1 of the agitator 3 to be provided when the transport member 131 is disposed at the first position. That is, the small diameter portion 105 cannot be engaged with the cam contact portion 135 of the transport member 131.

The gradually decreasing portion 106 is adjacently arranged on the upstream in the rotation direction R with respect to the small diameter portion 105. The upstream end portion in the rotation direction R of the gradually decreasing portion 106 is connected to the downstream end portion in the rotation direction R of the large diameter portion 104. The gradually decreasing portion 106 is the portion at which the central angle is approximately 210° in the cam 101, and the gradually decreasing portion 106 has a substantially semicircular form as viewed in a side view.

Further, the radius of curvature of the gradually decreasing portion 106 is gradually decreased at positions disposed on the more upstream side in the rotation direction R. Further, the radius of curvature R3 of the downstream end portion in the rotation direction R of the gradually decreasing portion 106 is substantially the same as the radius of curvature R1 of the large diameter portion 104. Further, the radius of curvature R4 of the upstream end portion in the rotation direction R of the gradually decreasing portion 106 is substantially the same as the radius of curvature R2 of the small diameter portion 105.

The agitating blade 98 is composed of a film material having the flexibility including, for example, polyethylene terephthalate (PET). One end portion of the agitating blade 98 is fixed to the main shaft body 99.

As depicted in FIG. 3, the agitator 3 is arranged in the toner accommodating chamber 7 so that the right rotational movement shaft 100 is rotatably received in the bearing section 78, and the left rotational movement shaft 100 is inserted into the gear insertion hole 61.

The coil spring 94 has such a coil-shaped form that the wire material is wound in a helical form in the left-right direction. The inner diameter of the coil spring 94 is larger than the outer diameter of the rotational movement shaft 100, which is larger than the outer diameter of a bearing cylinder 122 as described later on. Thus, the left rotational movement shaft 100 is inserted into the coil spring 94, and the coil spring 94 is arranged between the cam 101 of the agitator shaft 97 and the circumferential edge of the gear insertion hole 61 of the left side wall 47. Accordingly, the left end portion of the coil spring 94 is brought in contact with the circumferential edge of the gear insertion hole 61, and the right end portion of the coil spring 94 is brought in contact with the left surface of the cam 101.

Accordingly, the coil spring 94 ordinarily urges the cam 101 toward the right. Therefore, the agitator 3 is urged toward the right by means of the urging force of the coil spring 94. The left end portion of the coil spring 94 is received from the right by the spring support section 64. Accordingly, the coil spring 94 is regulated for the movement in the radial direction.

The agitator gear 93 is attached to the left end portion of the left rotational movement shaft 100 while the agitator gear 93 is incapable of performing the relative rotation. The agitator gear 93 has a cylindrical form extending in the left-right direction, and the agitator gear 93 integrally has a gear section 121 and a bearing cylinder 122.

The gear section 121 is the left portion of the agitator gear 93, and the gear section 121 has gear teeth on the entire circumferential surface thereof.

The bearing cylinder 122 is the right portion of the agitator gear 93, and the bearing cylinder 122 has a substantially cylindrical form in which the central axis is coincident with that of the gear section 121. Further, the outer diameter of the bearing cylinder 122 is smaller than the outer diameter of the gear section 121, which is substantially the same as the inner diameter of the gear insertion hole 61.

The agitator gear 93 is attached to the left rotational movement shaft 100 while the bearing cylinder 122 is inserted into the gear insertion hole 61 from the left so that the bearing cylinder 122 is relatively rotatable. Accordingly, the gear section 121 of the agitator gear 93 is arranged on the left with respect to the left side wall 47.

Further, the agitator 3 is supported by the case 2 such that the right rotational movement shaft 100 is rotatably supported by the bearing section 78, and the left rotational movement shaft 100 is rotatably supported by the circumferential edge of the gear insertion hole 61 by the aid of the bearing cylinder 122. Accordingly, the agitator 3 is rotatable by using the central axis A1 of the rotational movement shaft 100 as the center of rotation. In other words, the central axis A1 of the rotational movement shaft 100 is an example of the axis of rotation of the agitator 3.

<Transport Unit>

Further, as depicted in FIG. 1B, the developing cartridge 1 is provided with a transport unit 130 at a boundary portion between the toner accommodating chamber 7 and the developing chamber 8. In other words, the transport unit 130 is arranged on the back of the agitator 3, i.e., on the side of the developing chamber 8.

As depicted in FIG. 3, the transport unit 130 is provided with a transport member 131, a film member 141, and a spring member 132.

The transport member 131 integrally has a swinging movement shaft 133, a flange section 142, a transport section 134 as an example of the main body portion, a cam contact portion 135, a disengagement-preventive section 136, and a raking section 137. As described in detail later on, the transport member 131 is movable between the first position at which the toner is transported toward the supply roller 5 as depicted in FIG. 5A and FIG. 5B and the second position at which the toner is permitted to be supplied from the toner accommodating chamber 7 to the developing chamber 8 as depicted in FIG. 6A and FIG. 6B.

Figure 5B:
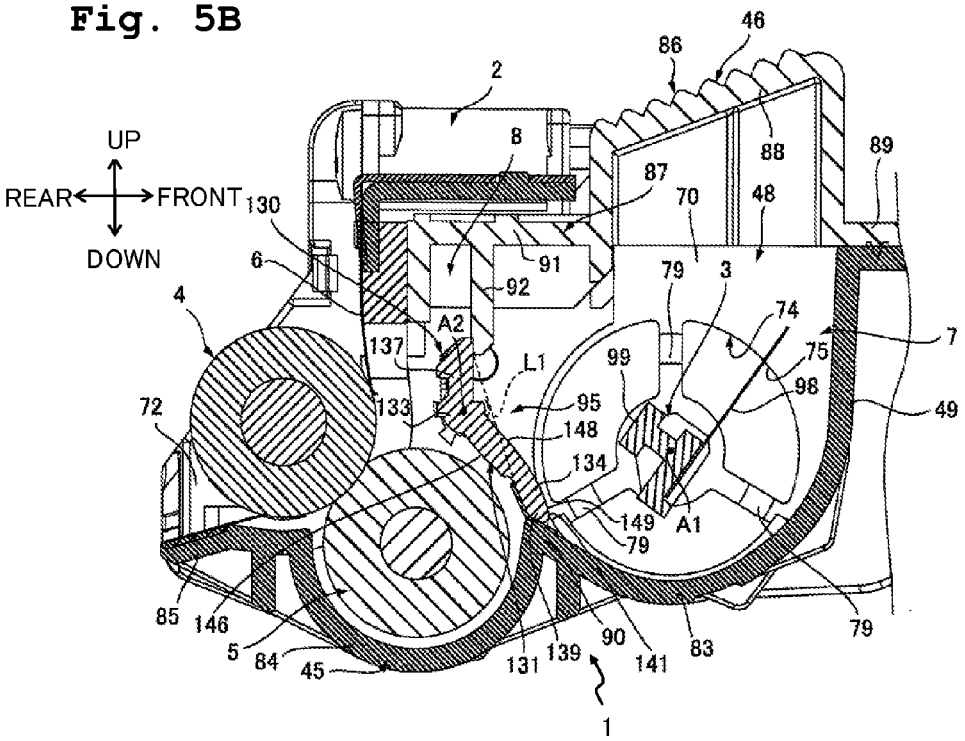
FIG. 5B shows a left side sectional view illustrating the developing cartridge depicted in FIG. 5A.
Figure 6A:
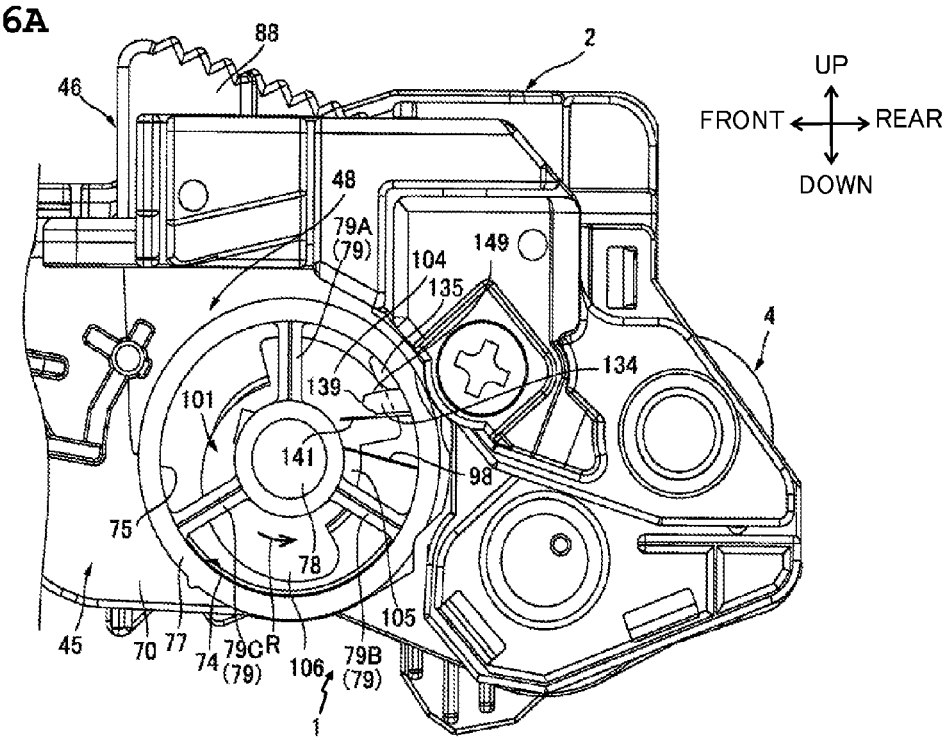
FIG. 6A shows a right side view illustrating the developing cartridge depicted in FIG. 1A, depicting a state in which the transport member is disposed at a second position.
Figure 6B:
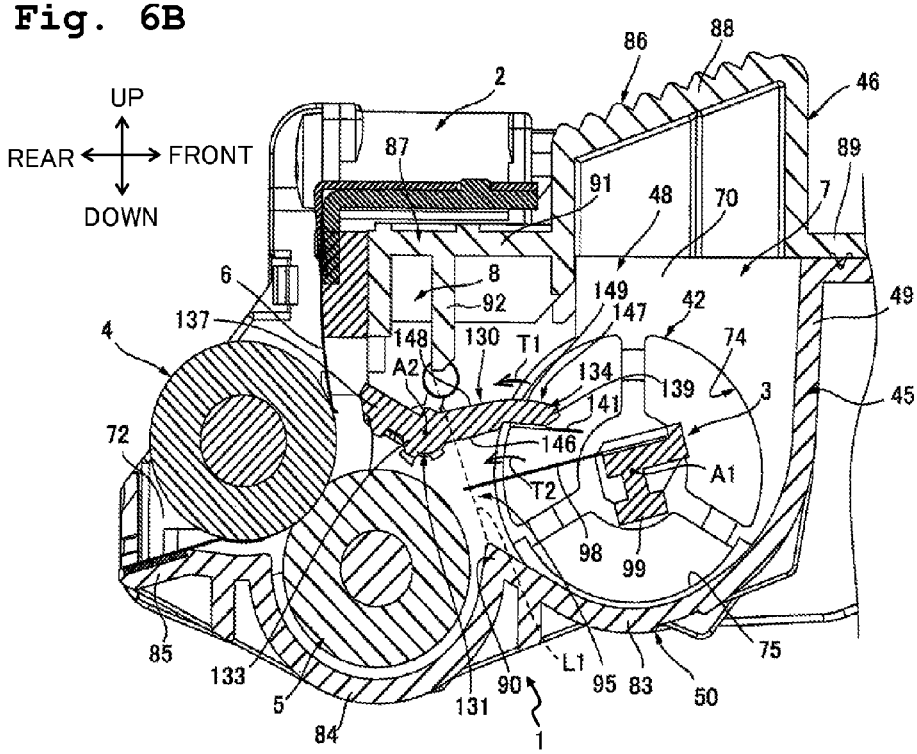
FIG. 6B shows a left side sectional view illustrating the developing cartridge depicted in FIG. 6A.

In view of the above, in the following explanation about the transport member 131, the explanation will be made assuming that the state, in which the transport member 131 is disposed at the first position depicted in FIG. 1B, FIG. 5A, and FIG. 5B, is the basis or reference.

As depicted in FIG. 3 and FIG. 4, the swinging movement shaft 133 has a substantially columnar form extending in the left-right direction.

The flange section 142 is arranged slightly on the right as compared with the left end surface of the swinging movement shaft 133. The flange section 142 is spread outwardly in the radial direction of the swinging movement shaft 133 from the entire circumference of the swinging movement shaft 133. The flange section 142 has a substantially annular form in which the swinging movement shaft 133 is the center.

The transport section 134 has a substantially rectangular plate-shaped form extending in the left-right direction as viewed in a front view. As depicted in FIG. 1B, the transport section 134 continuously extends from the lower-front end portion of the circumferential surface of the swinging movement shaft 133 outwardly in the radial direction of the swinging movement shaft 133.

Further, as depicted in FIG. 4, the left upper end portion of the transport section 134 is cut out in a substantially rectangular form as viewed in a front view. Accordingly, as depicted in FIG. 3 and FIG. 4, the left end portion of the transport section 134 is not continued to the portion of the swinging movement shaft 133 disposed on the left as compared with the flange section 142, and they are arranged while providing a spacing in the radial direction of the swinging movement shaft 133.

Further, the size or dimension in the left-right direction of the transport section 134 is smaller than the dimension in the left-right direction of the swinging movement shaft 133. Thus, the end portion in the left-right direction of the transport section 134 is positioned inwardly in the left-right direction as compared with the left and right end portions of the swinging movement shaft 133.

Further, as depicted in FIG. 1B, one surface 146 of the transport section 134 is confronted with the circumferential surface of the supply roller 5 while providing a spacing therebetween. The one surface 146 of the transport section 134 continuously extends in a straight line form downwardly in the front direction from the lower end portion of the circumferential surface of the swinging movement shaft 133 as viewed in a side view.

Further, the other surface 147 of the transport section 134 is the surface opposite to the one surface 146 of the transport section 134, and the other surface 147 has, as an example of the flat surface, a first portion 148 and a second portion 149.

The first portion 148 is the inner portion in the radial direction of the other surface 147 of the transport section 134, and the first portion 148 extends continuously in a straight line form downwardly in the front direction from the lower-front end portion of the circumferential surface of the swinging movement shaft 133 as viewed in a side view. Further, as depicted in FIG. 3, the first portion 148 extends in the left-right direction of the entire transport section 134, and the first portion 148 is constructed as the smooth surface having neither protrusions nor recesses.

As depicted in FIG. 1B, the second portion 149 is the outer portion in the radial direction of the other surface 147 of the transport section 134, and the second portion 149 extends continuously in a circular arc-shaped form downwardly in the front direction from the outer end portion in the radial direction of the first portion 148 as viewed in a side view. Further, as depicted in FIG. 3, the second portion 149 extends in the left-right direction of the entire transport section 134, and the second portion 149 is constructed as the smooth surface having neither protrusions nor recesses.

Further, as depicted in FIG. 4, the transport section 134 has a passage groove 138. The passage groove 138 is arranged at a left lower end portion of the transport section 134. The passage groove 138 has a substantially U-shaped form as viewed in a front view opened toward the bottom (downward), and the passage groove 138 is recessed inwardly in the radial direction of the swinging movement shaft 133 from the left end portion of the lower end edge of the transport section 134.

The cam contact portion 135 is arranged above the passage groove 138 at the front surface of the transport section 134. The cam contact portion 135 has a substantially rectangular plate-shaped form as viewed in a plan view, and the cam contact portion 135 protrudes toward the front continuously from the upper circumferential edge of the passage groove 138 disposed in the transport section 134.

As depicted in FIG. 3, the disengagement-preventive section 136 adjacently arranged on the left of the cam contact portion 135 on the front surface of the transport section 134. The disengagement-preventive section 136 has a substantially rectangular plate-shaped form as viewed in a side view, and the disengagement-preventive section 136 protrudes toward the top (upward) from the front surface of the transport section 134. Further, the right surface of the disengagement-preventive section 136 is connected to the left end portion of the cam contact portion 135, and the upper end portion of the disengagement-preventive section 136 is positioned slightly upwardly as compared with the upper end portion of the cam contact portion 135.

As depicted in FIG. 4, the raking section 137 has a substantially rectangular plate-shaped form extending in the left-right direction as viewed in a front view. As depicted in FIG. 1B, the raking section 137 continuously extends outwardly in the radial direction of the swinging movement shaft 133 from the upper end portion of the circumferential surface of the swinging movement shaft 133. Accordingly, the raking section 137 is arranged while providing a spacing of about 120° in the circumferential direction of the transport section 134 with respect to the swinging movement shaft 133.

Further, the left lower end portion of the raking section 137 is cut out in a substantially rectangular form as viewed in a front view. Accordingly, the left end portion of the raking section 137 is not continued to the portion disposed on the left as compared with the flange section 142 of the swinging movement shaft 133, and they are arranged while providing a spacing in the radial direction of the swinging movement shaft 133.

Further, the dimension (size) in the left-right direction of the raking section 137 is smaller than the dimension (size) in the left-right direction of the swinging movement shaft 133. Further, the end portion in the left-right direction of the raking section 137 is positioned inwardly in the left-right direction as compared with the end portion in the left-right direction of the swinging movement shaft 133. Further, the front surface of the raking section 137 is constructed as the smooth surface extending in the left-right direction.

As depicted in FIG. 3 and FIG. 4, the film member 141 is composed of a film material having the flexibility including, for example, polyethylene terephthalate (PET). The film member 141 has a substantially rectangular form extending in the left-right direction. The dimension (size) in the left-right direction of the film member 141 is substantially the same as the dimension (size) in the left-right direction ranging from the right end portion of the transport section 134 to the right end edge of the passage groove 138.

Thus, as depicted in FIG. 1B, the film member 141 is supported by the transport member 131 such that the inner portion in the radial direction of the film member 141 is fixed to the outer end portion in the radial direction of the one surface 146 of the transport section 134.

As depicted in FIG. 3, the spring member 132 integrally has a coil section 143, a first arm section 144, and a second arm section 145.

The coil section 143 has such a coil-shaped form that the wire material is wound in a helical form in the left-right direction.

The first arm section 144 is drawn out toward the top (upward) in the tangential direction from one end portion of the wire material of the coil section 143, specifically from the left rear end portion of the coil section 143, and then the first arm section 144 is folded back to make a U-turn.

The second arm section 145 is drawn out toward the front in the tangential direction from the other end portion of the wire material of the coil section 143, specifically from the right lower end portion of the coil section 143, and then the second arm section 145 is curved toward the bottom (downward).

Thus, the spring member 132 is supported by the transport member 131 such that the left end portion of the swinging movement shaft 133 is inserted into the coil section 143, and the front end portion of the second arm section 145 is hooked or caught by the front end portion of the cam contact portion 135. Accordingly, the coil section 143 of the spring member 132 is adjacently arranged on the left of the flange section 142, and the second arm section 145 of the spring member 132 is adjacently arranged on the right of the disengagement-preventive section 136.

The transport unit 130 as described above is supported by the case 2 such that the both left and right end portions of the swinging movement shaft 133 of the transport member 131 are inserted respectively into the corresponding shaft insertion hole 60 and the unillustrated shaft insertion hole so that they are relatively rotatable. Accordingly, as depicted in FIG. 1B, the transport member 131 is arranged in the communication port 95, and the transport member 131 is constructed to be swingable by using the central axis A2 of the swinging movement shaft 133 as the center of rotation. Further, the swinging movement shaft 133 of the transport member 131 is positioned upwardly as compared with the center C in the up-down direction of the communication port 95.

Further, as depicted in FIG. 2A and FIG. 4, the coil section 143 of the spring member 132 is allowed to intervene between the circumferential edge of the shaft insertion hole 60 disposed on the left side wall 47 and the flange section 142. Therefore, the coil section 143 ordinarily urges the flange section 142 of the transport member 131 toward the right.

Thus, as depicted in FIG. 4, the first arm section 144 of the spring member 132 is inclined toward the front against the urging force exerted by the torsion of the spring member 132, and the first arm section 144 abuts against the lower end portion of the fastening wall 67 from the downward position. Accordingly, the second arm section 145 of the spring member 132 urges the cam contact portion 135 downwardly in the backward direction by means of the urging force exerted by the torsion of the spring member 132. Therefore, the transport member 131 is ordinarily urged in the counterclockwise direction as viewed in a right side view by means of the urging force exerted by the torsion of the spring member 132.

Accordingly, the transport member 131 is ordinarily positioned at the first position at which the outer end portion in the radial direction of the raking section 137 is brought in contact with the lower end portion of the fastening wall 67 from the back. In other words, the lower end portion of the fastening wall 67 abuts against the outer end portion in the radial direction of the raking section 137, and thus the movement in the counterclockwise direction as viewed in a right side view of the transport member 131 is regulated.

Further, as depicted in FIG. 5B, the raking section 137 is arranged at the back of the upper portion of the communication port 95, and the upper portion of the communication port 95 is closed in a state in which the transport member 131 is disposed at the first position.

Further, the outer end portion 139 in the radial direction of the transport section 134 is arranged while slightly providing a spacing upwardly in the front direction with respect to the connecting portion 90 of the curved section 83 and the circular arc section 84, and the film member 141 is brought in contact with the connecting portion 90 in a state in which the transport member 131 is disposed at the first position.

Accordingly, the transport section 134 and the film member 141 close the lower portion of the communication port 95.

Further, as depicted in FIG. 3, the position in the left-right direction of the cam contact portion 135 of the transport member 131 is substantially the same as the position in the left-right direction of the cam 101 of the agitator 3. Further, the cam contact portion 135 of the transport member 131 is arranged in the rotation locus of the cam 101 of the agitator 3.

<Confirmation of Operation of Transport Member>

Next, an explanation will be made about the confirmation of operation of the transport member 131 after the assembling of the developing cartridge 1.

In order to confirm the operation of the transport member 131, the operator firstly disengages the cap 42 from the cylindrical section 77 of the right side wall 48, and then the driving force is input into the agitator gear 93.

Accordingly, as depicted in FIG. 1B and FIG. 5A, the agitator 3 is rotated in the rotation direction R, and the cam 101 is rotated in the rotation direction R in accordance with the rotation of the agitator 3. Thus, as depicted in FIG. 1B, the downstream end surface in the rotation direction R of the large diameter portion 104 of the cam 101 abuts against the cam contact portion 135 of the transport member 131 from the downward position.

Further, the downstream end surface in the rotation direction R of the large diameter portion 104 of the cam 101 presses the cam contact portion 135 toward the top (upward) in accordance with the rotation of the agitator 3. Accordingly, the transport member 131 swings clockwise as viewed in a right side view from the first position against the urging force brought about by the torsion of the spring member 132.

Accordingly, the outer end portion 139 in the radial direction of the transport section 134 is moved clockwise as viewed in a right side view about the center of the swinging movement shaft 133 to release the contact between the free end portion of the film member 141 and the connecting portion 90 of the curved section 83 and the circular arc section 84.

Subsequently, when the agitator 3 is further rotated, the circumferential surface of the large diameter portion 104 of the cam 101 is brought in contact with the cam contact portion 135 as depicted in FIG. 6A. Accordingly, as depicted in FIG. 6B, the transport member 131 further swings clockwise as viewed in a right side view against the urging force brought about by the torsion of the spring member 132, and the transport member 131 arrives at the second position. In other words, the large diameter portion 104 of the cam 101 is brought in contact with the cam contact portion 135, and thus the transport member 131 is positioned at the second position.

In this situation, the outer end portion 139 in the radial direction of the transport section 134 is separated upwardly in the front direction with respect to the connecting portion 90 of the curved section 83 and the circular arc section 84. Accordingly, the transport section 134 opens the portion of the communication port 95 disposed below the swinging movement shaft 133.

Further, the raking section 137 is positioned at the upper-rear side of the swinging movement shaft 133 in the developing chamber 8. Accordingly, the raking section 137 is arranged while providing the spacing in the direction to connect the upper position on the front and the lower position on the rear with respect to the partition wall 92, and the portion of the communication port 95, which is disposed above the swinging movement shaft 133, is opened. In other words, the transport member 131 divides the communication port 95 into two in the up-down direction in the state of being disposed at the second position, and the transport member 131, which is disposed at the second position, largely opens the communication port 95 as compared with the state in which the transport member 131 is disposed at the first position.

Further, as depicted in FIG. 6B, the transport section 134 extends generally in the radial direction of the toner filling port 74 in the state in which the transport member 131 is disposed at the second position, and the transport section 134 extends toward the center of the toner filling port 74.

Further, as depicted in FIG. 6A, the outer end portion 139 in the radial direction of the transport section 134 is arranged at the substantially central portion between the first crosspiece section 79A and the second crosspiece section 79B in the circumferential direction of the toner filling port 74 as viewed from the right. In other words, the outer end portion 139 in the radial direction of the transport section 134 is overlapped with the toner filling port 74 as viewed from the right. In other words, the toner filling port 74 is arranged so that the toner filling port 74 is overlapped with the movement locus of the transport member 131 as viewed from the right.

Accordingly, it is possible to confirm that the transport member 131 is arranged at the second position.

Subsequently, when the agitator 3 is further rotated, then the circumferential surface of the large diameter portion 104 of the cam 101 is separated from the cam contact portion 135, and the agitating blade 98 abuts against the outer end portion 139 in the radial direction of the transport section 134 from the downward position. When the agitator 3 is further rotated, the agitating blade 98 and the transport section 134 are released from the contact. Accordingly, the transport member 131 swings counterclockwise as viewed in a right side view until the cam contact portion 135 abuts against the circumferential surface of the gradually decreasing portion 106 of the cam 101 in accordance with the urging force brought about by the torsion of the spring member 132. In this situation, the passage groove 138 of the transport section 134 permits the passage of the gradually decreasing portion 106 of the cam 101.

Subsequently, when the agitator 3 is further rotated, the circumferential surface of the gradually decreasing portion 106 is slidably rubbed with the cam contact portion 135. Further, as the portion of the circumferential surface of the gradually decreasing portion 106, which is brought in contact with the cam contact portion 135, is moved toward the upstream in the rotation direction R, the transport member 131 continuously and gradually swings counterclockwise as viewed in a right side view.

Subsequently, when the agitator 3 is further rotated, then the circumferential surface of the gradually decreasing portion 106 of the cam 101 is separated from the cam contact portion 135 as depicted in FIG. 1B and FIG. 5B, and they are released from the slidable rubbing having been caused therebetween. Accordingly, the transport member 131 is allowed to swing counterclockwise as viewed in a right side view by means of the urging force brought about by the torsion of the spring member 132, and the transport member 131 is arranged at the first position again. In other words, the transport member 131 swings until the transport member 131 arrives at the first position again after the movement starting from the first position and traveling via the second position, in cooperation with the rotation of the agitator 3.

In this situation, as depicted in FIG. 5B, the transport section 134 is positioned outwardly in the radial direction of the rotation of the agitator 3 as compared with the circumferential edge 75 of the toner filling port 74, i.e., outwardly in the radial direction of the toner filling port 74. Therefore, as depicted in FIG. 5A, the outer end portion 139 in the radial direction of the transport section 134 is not overlapped with the toner filling port 74 as viewed from the right. Accordingly, it is possible to confirm that the transport member 131 is disposed at the first position.

In other words, when the driving force is input into the agitator gear 93, if the outer end portion 139 in the radial direction of the transport section 134 is overlapped with the toner filling port 74 in a situation in which the developing cartridge 1 is viewed from the right as depicted in FIG. 5A to FIG. 6B, and the outer end portion 139 is thereafter moved outwardly in the radial direction of the toner filling port 74 as compared with the circumferential edge 75 of the toner filling port 74, then it is possible to confirm that the transport member 131 swings from the first position to the second position. In other words, it is possible to confirm that the transport member 131 normally swings between the first position and the second position.

Further, it is possible to distinguish whether the transport member 131 is disposed at the first position or the second position depending on whether or not the outer end portion 139 in the radial direction of the transport section 134 is overlapped with the toner filling port 74 as viewed from the right, in other words, depending on whether or not the outer end portion 139 can be confirmed via the toner filling port 74.

<Toner Filling Operation>

Subsequently, an explanation will be made about the operation for filling the developing cartridge 1 with the toner. The filling operation with the toner is usually carried out during the production of the developing cartridge 1. However, the filling operation with the toner is also applied when the developing cartridge 1, which has been already used, is filled or charged with the toner again.

In order to fill the developing cartridge 1 with the toner, the operator firstly disengages the cap 42 from the cylindrical section 77 of the right side wall 48, and the toner filling port 74 is opened. Then, in the same manner as in the confirmation for confirming the operation of the transport member described above, the agitator 3 is rotated in the rotation direction R until the circumferential surface of the large diameter portion 104 of the cam 101 is brought in contact with the cam contact portion 135 of the transport member 131 as depicted in FIG. 6A, and the transport member 131 is arranged at the second position.

Subsequently, the arrangement is made by the operator such that the toner filling port 74 is directed upwardly, and the longitudinal direction of the developing cartridge 1 extends in the up-down direction. Accordingly, the right side wall 48 of the developing cartridge 1 is positioned upwardly, and the left side wall 47 of the developing cartridge 1 is positioned downwardly.

Then, an unillustrated toner filling device fills the toner accommodating chamber 7 of the case 2 with the toner in the up-down direction from the toner filling port 74.

In this situation, the transport member 131 is arranged at the second position, and hence the communication port 95 is open. Therefore, the toner, with which the toner accommodating chamber 7 is filled, is allowed to flow into the developing chamber 8 via the communication port 95.

In particular, as depicted in FIG. 6B, the toner, with which the toner accommodating chamber 7 is to be filled, includes the first toner T1 which is allowed to flow into the developing chamber 8 from the toner accommodating chamber 7 via the area between the partition wall 92 and the swinging movement shaft 133 disposed at the communication port 95 and the second toner T2 which is allowed to flow into the developing chamber 8 from the toner accommodating chamber 7 via the area between the connecting portion 90 and the swinging movement shaft 133 disposed at the communication port 95.

The first toner T1 is discharged from the unillustrated toner filling device. After that, the first toner T1 flows toward the bottom (downward) along the second portion 149 of the other surface 147 of the transport section 134, and the first toner T1 flows toward the toner accommodating chamber 7. Further, the first toner T1 arrives at the first portion 148 from the second portion 149 of the other surface 147 of the transport section 134, and the first toner T1 flows toward the toner accommodating chamber 7 along the first portion 148. After that, the first toner T1 passes through the area between the partition wall 92 and the swinging movement shaft 133 disposed at the communication port 95, and the first toner T1 arrives at the interior of the developing chamber 8.

On the other hand, the second toner T2 is discharged from the unillustrated toner filling device. After that, the second toner T2 flows toward the bottom (downward) along the one surface 146 of the transport section 134, and the second toner T2 flows toward the toner accommodating chamber 7. Further, the second toner T2 passes through the area between the connecting portion 90 and the swinging movement shaft 133 disposed at the communication port 95, and the second toner T2 arrives at the interior of the developing chamber 8.

Accordingly, the toner accommodating chamber 7 and the developing chamber 8 are filled with the toner respectively.

Subsequently, the operator forcibly inserts the cap 42 into the cylindrical section 77 of the right side wall 48. Accordingly, the toner filling port 74 is closed.

According to the above, the toner filling operation for the developing cartridge 1 is completed.

<Toner Transport Operation by Transport Member>

Next, an explanation will be made about the transport operation for transporting the toner, performed by the transport member 131 with respect to the supply roller 5.

When the image forming operation is started as described above, the unillustrated driving source inputs the driving force into the developing roller 4 and the supply roller 5 respectively. Accordingly, as depicted in FIG. 7, the developing roller 4 and the supply roller 5 are rotated clockwise as viewed in a right side view respectively.

Further, the unillustrated driving source inputs the driving force into the gear section 121 of the agitator gear 93. Accordingly, as depicted in FIG. 1B, the agitator 3 is rotated in the rotation direction R.

Accordingly, in the same manner as in the confirmation for confirming the operation of the transport member described above, the cam 101 of the agitator 3 is brought in contact with the cam contact portion 135 of the transport member 131, and the transport member 131 is moved from the first position to the second position as depicted in FIG. 5A to FIG. 6B.

In this situation, as depicted in FIG. 6B, the free end portion of the agitating blade 98 of the agitator 3 arrives at the position disposed below the transport section 134 and above connecting portion 90. Accordingly, the agitating blade 98 supplies the toner accommodated in the toner accommodating chamber 7 to the developing chamber 8 so that the toner is fed from the front to the back by means of the elastic force.

In this situation, the transport section 134 regulates the upward flow of the toner beyond the transport section 134, the toner being supplied from accommodating chamber 7 to the developing chamber 8. The transport section 134 guides the flow of the toner directed toward the supply roller 5.

Subsequently, when the agitator 3 is further rotated, then the agitating blade 98 is brought in contact with the outer end portion 139 in the radial direction of the transport section 134 from the downward position, and the agitating blade 98 and the transport section 134 are thereafter released from the contact. Accordingly, as depicted in FIG. 1B, the transport member 131 swings counterclockwise as viewed in a right side view until the cam contact portion 135 abuts against the circumferential surface of the gradually decreasing portion 106 of the cam 101.

In this situation, the raking section 137 is moved counterclockwise as viewed in a right side view in accordance with the swinging movement of the transport member 131. Accordingly, the raking section 137 rakes out or scrapes out the toner positioned upwardly from the raking section 137 from the developing chamber 8 toward the toner accommodating chamber 7 via the upper portion of the communication port 95.

Subsequently, when the agitator 3 is further rotated, then the circumferential surface of the gradually decreasing portion 106 of the cam 101 and the cam contact portion 135 are released from the contact, and the transport member 131 is arranged at the first position again.

Accordingly, the toner, which is agitated by the agitator 3 and which is supplied from the toner accommodating chamber 7 to the developing chamber 8, is transported by the transport section 134 so that the toner is forcibly pushed toward the supply roller 5.

Further, the agitator 3 is continuously rotated. Accordingly, the transport member 131 repeats the cycle in which the transport member 131 swings from the first position to the second position and then the transport member 131 arrives at the first position again so that the cycle is successively continued. Accordingly, the transport member 131 continuously transports the toner from the toner accommodating chamber 7 to the developing chamber 8.

<Function and Effect>

According to the developing cartridge 1, as depicted in FIG. 5A and FIG. 5B, the toner filling port 74 is arranged so that the toner filling port 74 is overlapped with the movement locus of the transport member 131 as viewed from the right. Therefore, it is possible to realize the small size of the developing cartridge 1, while it is possible to confirm the movement of the transport member 131 via the toner filling port 74. In other words, it is possible to confirm the movement of the transport member 131 via the toner filling port 74 even after the assembling of the developing cartridge 1.

As depicted in FIG. 3, the agitator 3 has the cam 101. Therefore, as depicted in FIG. 6A, the large diameter portion 104 of the cam 101 is brought in contact with the cam contact portion 135 of the transport member 131, and thus the transport member 131 can be arranged at the second position at which the communication port 95 is opened largely as compared with the first position.

As a result, as depicted in FIG. 6B, when the transport member 131 is arranged at the second position during the filling with the toner, it is possible to suppress such a situation that the transport member 131 behaves as the obstacle for filling the developing chamber 8 with the toner.

Thus, the developing chamber 8 is smoothly filled with the toner fed from the toner accommodating chamber 7 via the communication port 95. Therefore, the toner accommodating chamber 7 and the developing chamber 8 can be reliably filled with the toner respectively. Therefore, it is possible to improve the volume of the toner accommodated in the case 2.

As depicted in FIG. 3, the cam 101 is arranged oppositely to the toner filling port 74. Therefore, it is possible to suppress such a situation that the cam 101 behaves as the obstacle during the filling with the toner.

As depicted in FIG. 6A, the outer end portion 139 in the radial direction of the transport section 134 is overlapped with the toner filling port 74 as viewed from the right when the transport member 131 is disposed at the second position. Therefore, it is possible to more reliably confirm the movement of the transport member 131 via the toner filling port 74.

As depicted in FIG. 3, the other surface 147 of the transport section 134 has the first portion 148 extending in the left-right direction.

Therefore, as depicted in FIG. 6B, the toner flows along the first portion 148 of the transport section 134 during the filling with the toner. As a result, it is possible to secure the smooth filling with the toner.

As depicted in FIG. 6B, the transport section 134 extends in the radial direction of the toner filling port 74 in the state in which the transport member 131 is disposed at the second position.

Therefore, the toner can be allowed to reliably flow into the both disposed in the circumferential direction of the toner filling port 74 with respect to the transport section 134 of the transport member 131 positioned at the second position during the filling with the toner. As a result, it is possible to allow the toner to sufficiently pass through the area between the swinging movement shaft 133 and the lower end portion of the partition wall 92 disposed at the communication port 95 and the area between the connecting portion 90 and the swinging movement shaft 133 disposed at the communication port 95 during the filling with the toner. Accordingly, it is possible to fill the case 2 with the toner more reliably.

Further, as depicted in FIG. 5B, the transport section 134 is positioned outwardly in the radial direction of the rotation of the agitator 3 as compared with the circumferential edge 75 of the toner filling port 74 when the transport member 131 is disposed at the first position. Therefore, as depicted in FIG. 5A, the transport member 131, which is disposed at the first position, has the transport section 134 which is not overlapped with the toner filling port 74 as viewed from the right.

In other words, the outer end portion 139 in the radial direction of the transport section 134 is not overlapped with the toner filling port 74 as viewed from the right when the transport member 131 is disposed at the first position, while the outer end portion 139 is overlapped with the toner filling port 74 as viewed from the right when the transport member 131 is disposed at the second position as depicted in FIG. 6A. Therefore, the position of the transport member 131 can be reliably grasped by confirming the transport section 134 via the toner filling port 74 as viewed from the right.

Further, it is possible to secure the large movement range when the transport member 131 is moved to the first position and the second position, and it is possible to transport the toner to the supply roller 5 more reliably.

First Modified Embodiment

Figure 8:
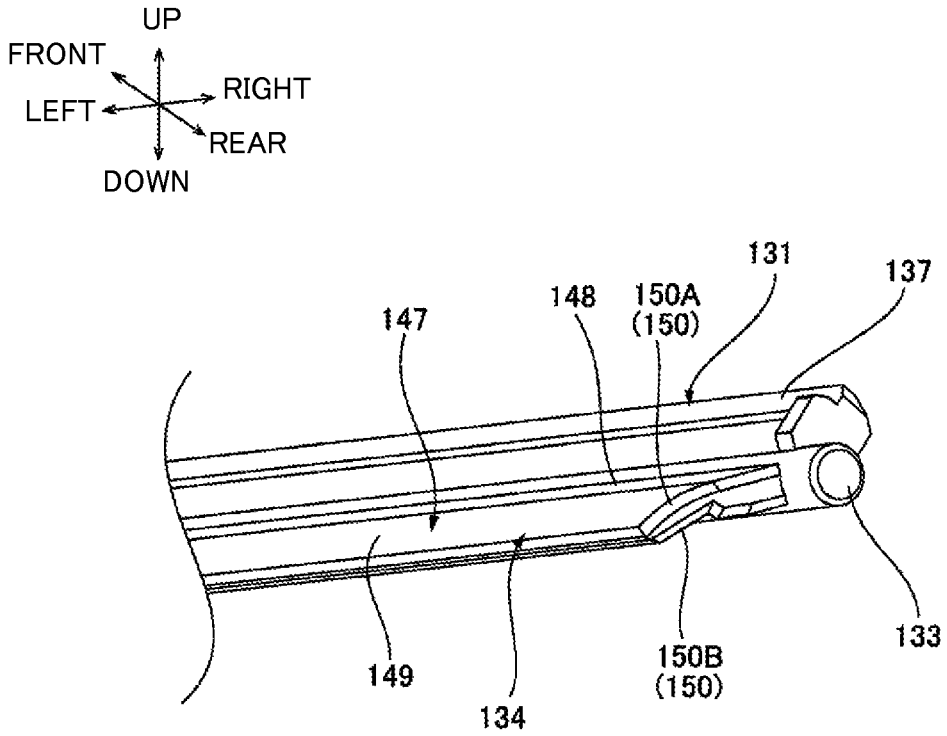
FIG. 8 shows a perspective view illustrating a transport member according to a modified embodiment of the present teaching as viewed from a right-front position.

As depicted in FIG. 8, it is also appropriate that the transport section 134 has guide surfaces 150. The guide surfaces 150 are arranged respectively at both front and rear end portions on the right end surface of the transport section 134. The front guide surface 150A is inclined leftwardly at more frontward positions, and the back guide surface 150B is inclined leftwardly at more backward positions.

Further, the guide surface 150 is mutually confronted with the toner filling port 74 in the left-right direction in a state in which the transport member 131 is disposed at the second position. Further, the guide surface 150 guides the flow of the toner during the filling with the toner. As a result, it is possible to secure the smoother filling with the toner.

Second Modified Embodiment

Further, in the embodiment described above, the case 2 is filled or charged with the toner in the state in which the transport member 131 is disposed at the second position. However, the present teaching is not limited thereto. The case 2 can be filled with the toner in a state in which the transport member 131 is disposed at the first position.

When the case 2 is filled with the toner in the state in which the transport member 131 is disposed at the first position, then the transport member 131 closes the communication port 95, and the outer end portion 139 in the radial direction of the transport section 134 is not overlapped with the toner filling port 74 as viewed from the right. Therefore, it is possible to reliably suppress such a situation that the transport section 134 behaves as the obstacle for the filling with the toner. Therefore, it is possible to smoothly fill the toner accommodating chamber 7 of the case 2 with the toner.

Third Modified Embodiment

In the embodiment described above, the supply roller 5 is adapted as an example of the roller member. However, it is also possible to adapt, for example, a brush-shaped roller as the roller member in place of the supply roller 5. Further, when the developing cartridge 1 is not provided with the supply roller 5, the developing roller 4 is adapted as an example of the roller member. It is also possible to adapt, for example, a developing sleeve or a brush-shaped roller in place of the developing roller 4.

Fourth Modified Embodiment

In the embodiment described above, the agitator 3 is adapted as an example of the agitating member. However, it is also possible to adapt, for example, an agitating member having a paddle as the agitating member in place of the agitator 3.

When the arrangements or constructions as described above are adopted, it is also possible to obtain the function and the effect which are the same as or equivalent to those of the embodiment described above.

It is noted that the embodiment and the modified embodiments can be appropriately combined with each other.

The case may have an opening which communicates the first accommodating section and the second accommodating section. The transport member may be configured to be movable to a first position and a second position, the opening being largely opened at the second position as compared with at the first position. In this arrangement, the agitating member has a contact portion which allows the transport member to be positioned at the second position by making contact with the transport member when the agitating member is rotated.

As described in the embodiment and the modified embodiments, the transport member is arranged on the side of the roller member as compared with the agitating member arranged for the first accommodating section having the filling port. Therefore, when the case is filled or charged with the developer via the filling port, then the transport member behaves as an obstacle for filling the second accommodating section with the developer, and it is sometimes impossible to fill the second accommodating section with the developer.

On the contrary, according to the configuration as described in the embodiment and the modified embodiments, the agitating member has the contact portion. Therefore, the transport member can be arranged at the second position at which the opening is opened largely as compared with a situation in which the transport member is arranged at the first position, by allowing the contact portion to make contact with the transport member.

Therefore, when the transport member is arranged at the second position during the filling with the developer, it is possible to suppress such a situation that the transport member is the obstacle for filling the second accommodating section with the developer.

As a result, the second accommodating section is smoothly filled or charged with the developer from the first accommodating section via the opening. Therefore, the first accommodating section and the second accommodating section can be reliably filled with the developer respectively. Thus, it is possible to improve the volume of the developer which is accommodated in the case.

The filling port may be arranged at one end portion in the axial direction of the case. In this arrangement, the contact portion is arranged at the other end portion in the axial direction of the agitating member.

According to the configuration as described in the embodiment and the modified embodiments, the contact portion is arranged oppositely to the filling port. Therefore, it is possible to suppress such a situation that the contact portion is the obstacle during the filling with the developer.

The transport member may have a main body portion which is overlapped with the filling port as viewed in the axial direction when the transport member is disposed at the second position.

According to the configuration as described in the embodiment and the modified embodiments, the main body portion is overlapped with the filling port as viewed in the axial direction when the transport member is disposed at the second position. Therefore, it is possible to confirm the movement of the transport member via the filling port.

The main body portion may have a flat surface which extends in the axial direction.

According to the configuration as described in the embodiment and the modified embodiments, the developer flows along the flat surface of the main body portion when the filling is performed with the developer. Therefore, it is possible to secure the smooth filling with the developer even when the main body portion of the transport member disposed at the second position is overlapped with the filling port as viewed in the axial direction.

The main body portion may be constructed to face the filling port, and the main body portion may have a guide surface for guiding the filling with the developer.

According to the configuration as described in the embodiment and the modified embodiments, the guide surface guides the filling with the developer when the filling with the developer is performed. Therefore, it is possible to secure the smoother filling with the developer.

The filling port may have a substantially circular shape as viewed in the axial direction. The main body portion may extend in a radial direction of the filling port when the transport member is disposed at the second position.

According to the configuration as described in the embodiment and the modified embodiments, the main body portion extends in the radial direction of the filling port in the state in which the transport member is disposed at the second position. Therefore, when the filling is performed with the developer, it is possible to allow the developer to reliably flow into the both in the circumferential direction of the filling port with respect to the main body portion of the transport member disposed at the second position. Therefore, it is possible to fill the case with the developer more reliably.

The main body portion may be positioned outwardly in the radial direction of the rotation of the agitating member as compared with a circumferential edge of the filling port when the transport member is disposed at the first position.

According to the configuration as described in the embodiment and the modified embodiments, when the transport member is disposed at the first position, the main body portion is positioned outwardly in the radial direction of the rotation of the agitating member as compared with the circumferential edge of the filling port. Therefore, the main body portion is not overlapped with the filling port as viewed in the axial direction.

In other words, the main body portion is not overlapped with the filling port as viewed in the axial direction when the transport member is disposed at the first position. The main body portion is overlapped with the filling port as viewed in the axial direction when the transport member is disposed at the second position. Therefore, it is possible to reliably grasp the position of the transport member by confirming the main body portion via the filling port as viewed in the axial direction.

Further, the transport member is greatly moved so that the main body portion is positioned outwardly in the radial direction as compared with the circumferential edge of the filling port when the transport member is disposed at the first position. In other words, it is possible to secure the large movement range when the transport member is moved to the first position and the second position. It is possible to transport the developer to the roller member more reliably.

According to the present teaching, it is possible to confirm the movement of the transport member easily and reliably.

What is claimed is:

1. A development apparatus comprising:

a case configured to accommodate a developer;

a roller member rotatably supported by the case and configured to transport a developer;

an agitating member rotatably supported by the case, and configured to agitate the developer; and a movable transport member configured to transport the developer, which is agitated by the agitating member, toward the roller member, the transport member including a main body portion extending from a one end portion of the transport member to another end portion of the transport member in an axial direction lying along an axis of rotation of the agitating member;

wherein the case includes:

a first accommodating section in which the agitating member is arranged, and in which a filling port for performing filling with a developer is formed, and a second accommodating section in which the roller member is arranged and which is communicated with the first accommodating section;

wherein the transport member is arranged on a side of the roller member as compared with the agitating member; and wherein the filling port is arranged such that the filling port is overlapped, as viewed in the axial direction king along the axis of rotation of the agitating member, with a movement locus of the main body portion extending from the one end portion of the transport member to the other end portion of the transport member.

2. The development apparatus according to claim 1, wherein an opening which makes communication between the first accommodating section and the second accommodating section is formed in the case;

the transport member is configured to be movable to a first position and a second position, the opening being largely opened at the second position as compared with at the first position; and the agitating member includes a contact portion which allows the transport member to be positioned at the second position by making contact with the transport member when the agitating member is rotated.

3. The development apparatus according to claim 2, wherein the filling port is arranged at one end portion in the axial direction of the case; and the contact portion is arranged at the other end portion in the axial direction of the agitating member.

4. The development apparatus according to claim 1, wherein the transport member is configured to be pivotable between a first position and a second position.

5. The development apparatus according to claim 1, wherein the transport member is configured to be movable between a first position and a second position, and the development apparatus further comprises a biasing member configured to bias the transport member toward the first position.

6. An image forming apparatus configured to form an image on a medium, comprising:

a main casing;

a fixing unit accommodated in the casing;

a process cartridge configured to be removable with respect to the main casing, the process cartridge including a drum cartridge and the development apparatus as defined in claim 1; and a scanner unit configured to emit a light beam toward the drum cartridge.

7. A development apparatus comprising:

a case configured to accommodate a developer;

a roller member rotatably supported by the case and configured to transport a developer;

an agitating member rotatably supported by the case, and configured to agitate the developer; and a movable transport member configured to transport the developer, which is agitated by the agitating member, toward the roller member;

wherein the case includes:

a first accommodating section in which the agitating member is arranged, and in which a filling port for performing filling with a developer is formed, and a second accommodating section in which the roller member is arranged and which is communicated with the first accommodating section;

wherein the transport member is arranged on a side of the roller member as compared with the agitating member;

wherein the filling port is arranged such that the filling port is overlapped with a movement locus of the transport member as viewed in an axial direction lying along an axis of rotation of the agitating member;

wherein an opening which makes communication between the first accommodating section and the second accommodating section is formed in the case;

wherein the transport member is configured to be movable to a first position and a second position, the opening being largely opened at the second position as compared with at the first position; and wherein the agitating member includes a contact portion which allows the transport member to be positioned at the second position by making contact with the transport member when the agitating member is rotated; and wherein the transport member includes a main body portion which is overlapped with the filling port as viewed in the axial direction when the transport member is disposed at the second position.

8. The development apparatus according to claim 7, wherein the main body portion includes a flat surface which extends in the axial direction.

9. The development apparatus according to claim 7, wherein the main body portion is configured to face the filling port, and the main body portion includes a guide surface for guiding the filling with the developer.

10. The development apparatus according to claim 7, wherein the filling port has a substantially circular shape as viewed in the axial direction; and the main body portion extends in a radial direction of the filling port when the transport member is disposed at the second position.

11. The development apparatus according to claim 7, wherein the main body portion is positioned outwardly in the radial direction of the rotation of the agitating member as compared with a circumferential edge of the filling port when the transport member is disposed at the first position.

12. A development apparatus comprising:

a case configured to accommodate a developer;

a roller member rotatably supported by the case and configured to transport a developer;

an agitating member rotatably supported by the case, and configured to agitate the developer; and a movable transport member configured to transport the developer, which is agitated by the agitating member, toward the roller member;

wherein the case includes:

a first accommodating section in which the agitating member is arranged, and in which a filling port for performing filling with a developer is formed; and a second accommodating section in which the roller member is arranged and which is communicated with the first accommodating section;

wherein an opening which makes communication between the first accommodating section and the second accommodating section is formed in the case, wherein the transport member is arranged on a side of the roller member as compared with the agitating member;

wherein the transport member is configured to be movable between a first position and a second position; and wherein the transport member is configured to push the toner toward the roller member and close the opening, under a condition that the transport member moves from the second position to the first position.

13. The development apparatus according claim 12, wherein the transport member is inclined under a condition that the transport member is located at the first position.

* * * * *